US009095217B2

(12) United States Patent
Oda

(10) Patent No.: US 9,095,217 B2
(45) Date of Patent: Aug. 4, 2015

(54) CHAIR

(71) Applicant: Okamura Corporation, Kanagawa (JP)

(72) Inventor: Youichirou Oda, Yokohama (JP)

(73) Assignee: Okamura Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 14/353,986

(22) PCT Filed: Nov. 2, 2012

(86) PCT No.: PCT/JP2012/078454

§ 371 (c)(1),
(2) Date: Apr. 24, 2014

(87) PCT Pub. No.: WO2013/065815

PCT Pub. Date: May 10, 2013

(65) Prior Publication Data

US 2014/0300164 A1 Oct. 9, 2014

(30) Foreign Application Priority Data

Nov. 4, 2011 (JP) ..... 2011-242881
Sep. 28, 2012 (JP) ..... 2012-215917

(51) Int. Cl.
*A47C 1/024* (2006.01)
*A47C 3/026* (2006.01)
*A47C 1/032* (2006.01)

(52) U.S. Cl.
CPC ..... *A47C 1/024* (2013.01); *A47C 1/03255* (2013.01); *A47C 1/03266* (2013.01); *A47C 1/03272* (2013.01)

(58) Field of Classification Search
CPC ..... A47C 1/03266; A47C 1/03255
USPC ..... 297/300.1, 300.2, 300.3, 300.7
See application file for complete search history.

(56) References Cited

U.S. PATENT DOCUMENTS 4,537,445 A * 8/1985 Neuhoff ..... 297/300.3
4,709,962 A * 12/1987 Steinmann ..... 297/300.3

(Continued)

FOREIGN PATENT DOCUMENTS

JP 6-20456 Y2 6/1994
JP 2003-245155 A 9/2003

(Continued)

OTHER PUBLICATIONS

International Search Report Corresponding to PCT/JP2012/078454 mailed Jan. 22, 2013.

*Primary Examiner* — Rodney B White
(74) *Attorney, Agent, or Firm* — Davis & Bujold, P.L.L.C.; Michael J. Bujold

(57) ABSTRACT

A chair in which a biasing force acting on a back can be changed even if the stroke of a moving member is small, thereby enabling the device to be compact, and the biasing force can be steplessly adjusted with light force. A biasing force transmission member (41) reverses the biasing force of a biasing mechanism acting on a tip portion of the biasing force transmission member (41) which is a point of effort (Q) with a point abutting a fulcrum member (49) working as a fulcrum (P) for a lever, transmits the biasing force to a base end of the biasing force transmission member (41) which is a point load (R) to bias the back in an upright direction, and moves the fulcrum member (49) along a side edge of the biasing force transmission member (41) on a pressure receiving side to be able to adjust the biasing force.

20 Claims, 36 Drawing Sheets

(56) References Cited

U.S. PATENT DOCUMENTS

| | | | | |
|---|---|---|---|---|
| 4,966,411 | A * | 10/1990 | Katagiri et al. | 297/300.7 |
| 6,086,153 | A * | 7/2000 | Heidmann et al. | 297/300.1 |
| 6,250,715 | B1 * | 6/2001 | Caruso et al. | 297/300.2 X |
| 7,097,249 | B2 * | 8/2006 | Igarashi et al. | 297/300.2 X |
| 7,566,097 | B2 * | 7/2009 | Sander et al. | 297/300.2 |
| 2004/0095007 | A1 * | 5/2004 | Wilkerson et al. | 297/300.1 |
| 2004/0183350 | A1 * | 9/2004 | Schmitz et al. | 297/300.1 X |
| 2005/0236878 | A1 * | 10/2005 | Rossetto et al. | 297/300.8 |
| 2006/0284461 | A1 * | 12/2006 | Machael et al. | 297/300.1 |
| 2007/0210633 | A1 * | 9/2007 | Proctor | 297/300.1 |
| 2009/0021065 | A1 | 1/2009 | Brauning | |
| 2010/0141002 | A1 * | 6/2010 | Kurrasch et al. | 297/300.1 |
| 2012/0161482 | A1 * | 6/2012 | Hayashi | 297/300.1 |

FOREIGN PATENT DOCUMENTS

| | | | |
|---|---|---|---|
| JP | 4087653 | B | 2/2004 |
| JP | 2007-37599 | A | 2/2007 |
| JP | 2009-534134 | A | 9/2009 |
| JP | 2010-94339 | A | 4/2010 |
| JP | 2010-158438 | A | 7/2010 |
| WO | 2007/124609 | A2 | 11/2007 |

* cited by examiner

CHAIR

TECHNICAL FIELD

This application is a National Stage completion of PCT/JP2012/078454 filed Nov. 2, 2012, which claims priority from Japanese patent application serial nos. 2012-215917 filed Sep. 28, 2012 and 2011-242881 filed Nov. 4, 2011.

The present invention relates to a chair in which the backrest is tilted backward wherein the chair is capable of adjusting a biasing force of biasing means for biasing the backrest toward an upright position.

BACKGROUND ART

There are conventional adjusting means for adjusting a biasing force of biasing means for biasing the backrest toward an upright position as below:

(A) At a winding end of the coil spring for biasing the backrest toward an upright position, the nut which engages with the thread of the adjusting rod is turned by the handle to change initial load of the coil spring in Patent Literature 1.

(B) A plurality of rubber torsion springs is arranged along the pivot shaft turning with the backrest, and biasing force of the rubber torsion spring selectively acts on the pivot shaft in Patent Literature 2.

(C) On the transmitting path of a biasing force, changing a position where the biasing force acts applies strength and weakness to the biasing force to be transmitted in Patent Literatures 3 and 4.

PRIOR ART

Patent Literatures

Patent Literature 1: JP6-20456Y
Patent Literature 2: JP4087653B
Patent Literature 3: JP2010-158438A
Patent Literature 4: JP2010-94339A

SUMMARY OF THE INVENTION

Problems to be Solved by the Invention

The adjusting means in (A) to (C) involves the following disadvantages:

(A) The biasing force of the coil spring directly acts on the operation of the handle, thereby causing operation of the handle to decrease.

(B) The biasing force for biasing the backrest toward an upright position can be adjusted merely stepwise to disable it to adjust minutely.

(C) A stroke of a moving member has to be increased. It may be necessary to change layout of the biasing means and other members or to get the whole device larger.

In view of the disadvantages in the prior art, it is an object of the present invention to provide a chair in which a moving member has a small stroke, wherein the biasing force for acting on the backrest and adjustable range are changed greatly to make the whole device smaller, the biasing force acting on the backrest being adjusted by a weak force continuously.

Means for Solving the Problems

According to the present invention, the foregoing problems are solved as below:

(1) There is provided a chair comprising:

a base supported by a leg unit;

a seat over the base;

a pivot shaft pivotally mounted to the base transversely of the chair;

a backrest fixed at a front end to the pivot shaft and standing at a rear end of the seat, the backrest turning between an upright position where the backrest is upright and a rearward-inclined position where the backrest is inclined rearward around an axis of the pivot shaft;

a rotary member fixed at a proximal end to the pivot shaft; a biasing-force transmitting member pivotally mounted at a proximal end to an eccentric portion of the rotary member via a shaft; biasing means disposed between the biasing-force transmitting member and part of the base and storing a reaction force by compression;

a fulcrum member in the base, the fulcrum member being capable of coming in contact with a middle of a pressed side of the biasing-force transmitting member and of moving along the pressed side; and a moving member moving the fulcrum member along the pressed side of the biasing-force transmitting member, wherein the biasing-force transmitting member acts as a lever having a contact portion with the fulcrum member as fulcrum to reverse a biasing force of the biasing means acting on a distal end as a point of effort whereby the proximal end as a point of action biases the rotary member in a direction where the backrest stands up.

The difference between a distance from the fulcrum to the point of effort and a distance from the fulcrum to the point of action becomes twice of a moving distance of the fulcrum member. Hence, the fulcrum member slightly moves, so that the biasing force acting on the backrest can be changed greatly, thereby making the device itself smaller. The biasing force acting on the backrest can continuously be adjusted.

(2) In the item (1), when the backrest is upright, the fulcrum member is spaced from the pressed side of the biasing-force transmitting member or is in contact with the pressed side so that a biasing force of the biasing means does not act on the fulcrum member.

The fulcrum member can be moved by a weak force thereby enhancing operation capability.

(3) In the item (1), the contact portion of the fulcrum member to the biasing-force transmitting member is arcuate viewed from the axis of the pivot shaft.

The biasing-force transmitting member can be turned on the contact portion with the fulcrum member smoothly. The contact portion moves along the arcuate surface depending on a rotary angle of the biasing-force transmitting member. Wear does not gather locally, thereby enhancing durability. By employing that the contact portion moves depending on the rotary angle of the biasing-force transmitting member, the biasing force transmitted to the backrest can be increased as the backrest is inclined backward.

(4) In item (1), between the pressed side of the biasing-force transmitting member and a wall of the base facing the fulcrum member, the fulcrum member slides along the wall.

Guide for guiding the fulcrum member to move can partially be omitted thereby simplifying the structure.

(5) In item (1), the moving member comprises a pair of vertical link arms supported by the base to move longitudinally of the chair, the fulcrum member being disposed between facing surfaces of the pair of link arms.

The fulcrum member is disposed at the upper end of the pair of link arms, and the lower ends of the link arms are moved thereby increasing vertical moving range of the fulcrum member. Thus, the adjustable range of the biasing force of the biasing means increases the biasing force acting on the backrest can be changed more greatly.

(6) In the item (5), lower parts of the pair of link arms are pivotally mounted to sides of the horizontally-moving member which is supported by the base to move longitudinally of the chair.

The lower parts of the pair of link arms can stably be moved longitudinally of the chair while they are held on the horizontally-moving member.

(7) In the item (6), the horizontally-moving member and a lower end of the link arm pivotally mounted to the horizontally-moving member are disposed behind and below the biasing means.

The lower ends of the horizontally-moving member and links arms can be moved longitudinally of the chair without contacting with the biasing means. The vertical distance of the link arm increases thereby increasing vertical moving range of the fulcrum member.

(8) In the item (6), a pair of guide shafts projects on the horizontally-moving member and a pair of guide members is provided to move the pair of guide shafts.

The horizontally-moving member can be moved stably and smoothly with the pair of guide members longitudinally of the chair.

(9) In item (6), the base has a sliding surface supporting the horizontally-moving member so that the horizontally-moving member slides longitudinally of the chair.

The horizontally-moving member can be carried on a broader area of the sliding surface and moves longitudinally of the chair, so that the pair of link arms can be moved more stably. Hence, the fulcrum member at the upper end of the pair of link arms moves up and down while held horizontally.

(10) In item (5), the fulcrum members in the pair of link arms comprise rollers rotating around a pivot shaft.

The fulcrum member moves up and down along the side edge of the pressed side of the biasing-force transmitting member while rotating around a transverse pivot shaft. Without sliding resistance, the biasing force can be adjusted by a weak force.

(11) In item (5), in the base there is provided a position-changing device for changing a longitudinal position of a horizontally-moving member and a lower part of the link arm and for stopping the horizontally-moving member and the lower part of the link arm.

By changing a lower longitudinal position of the horizontally-moving member and link arm pivotally mounted thereto, a vertical position of the fulcrum member can easily be adjusted and can be fixed at a certain vertical position, thereby preventing the biasing force of the biasing means from changing when the backrest is inclined.

Advantages of the Invention

According to the present invention, there is provided a chair wherein, even if a stroke of moving member is small, the biasing force acting on the backrest can be changed greatly thereby making a whole device smaller; whereby the biasing force acting on the backrest can be adjusted by a weak force continuously.

EMBODIMENTS FOR CARRYING OUT THE INVENTION

One embodiment of the present invention will be described with respect to the drawings. In each view, the right and left are determined based on those viewed in a front elevational view.

Figure 1:
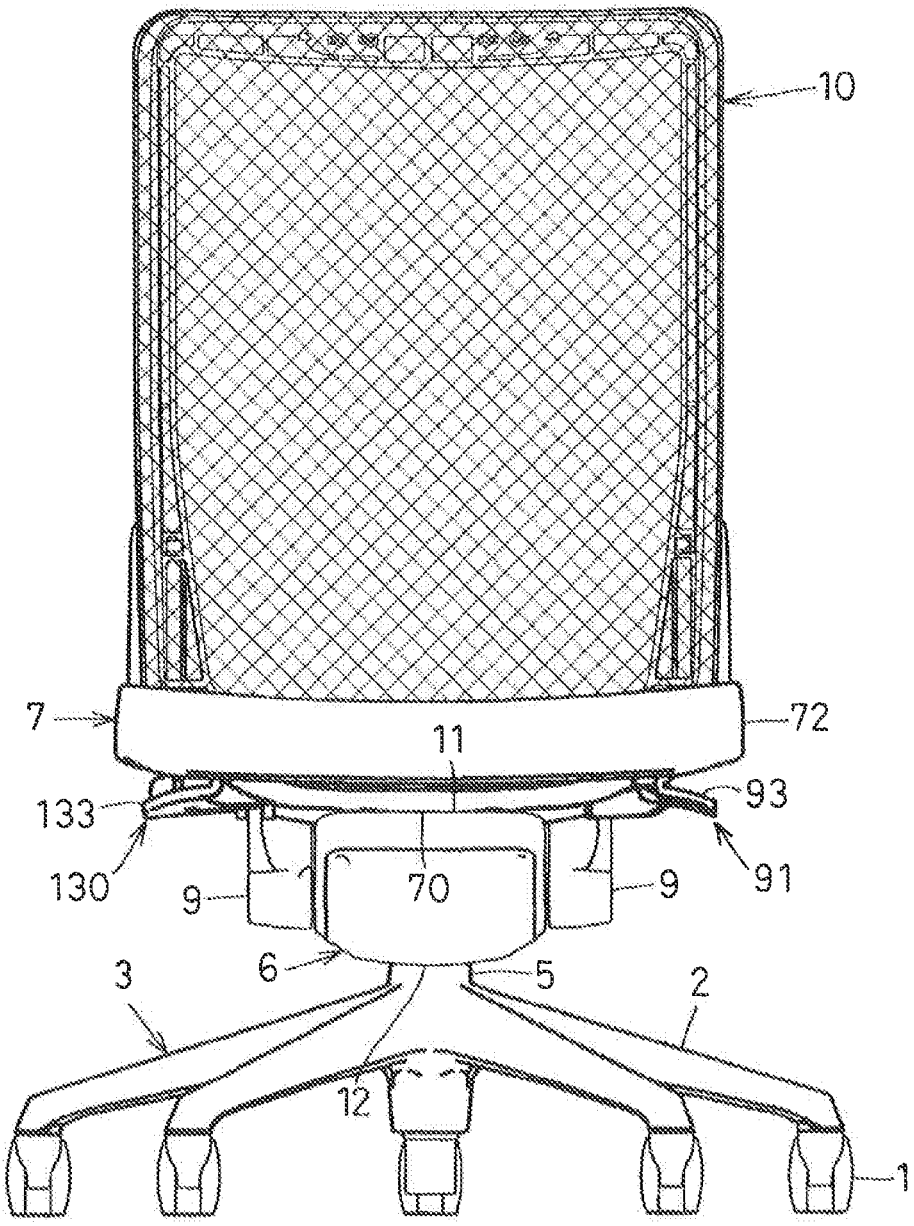
FIG. 1 is a front elevational view of one embodiment of the present invention.
Figure 2:
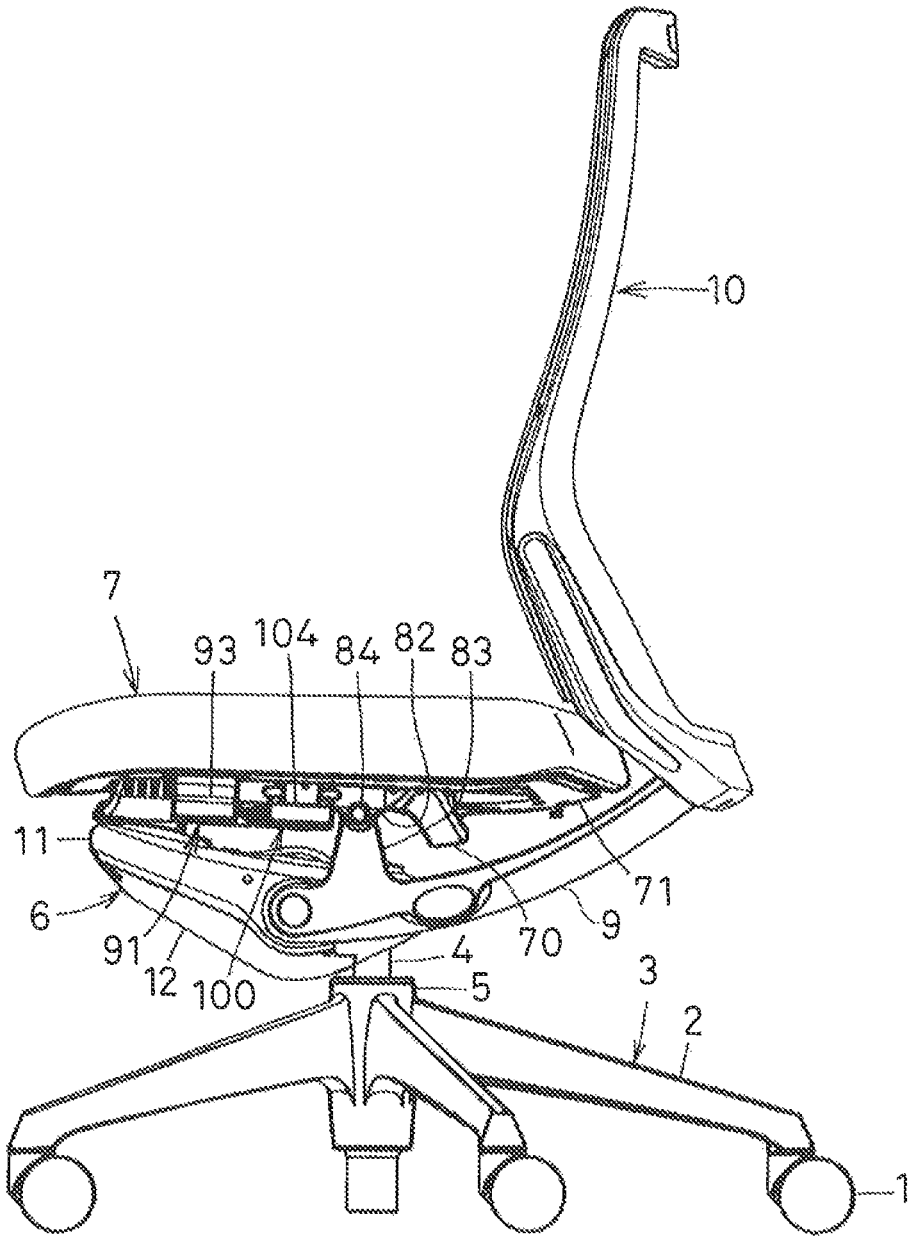
FIG. 2 is a side elevational view of thereof.

FIG. 1 is a front elevational view and FIG. 2 is a side elevational view.

Figure 7:
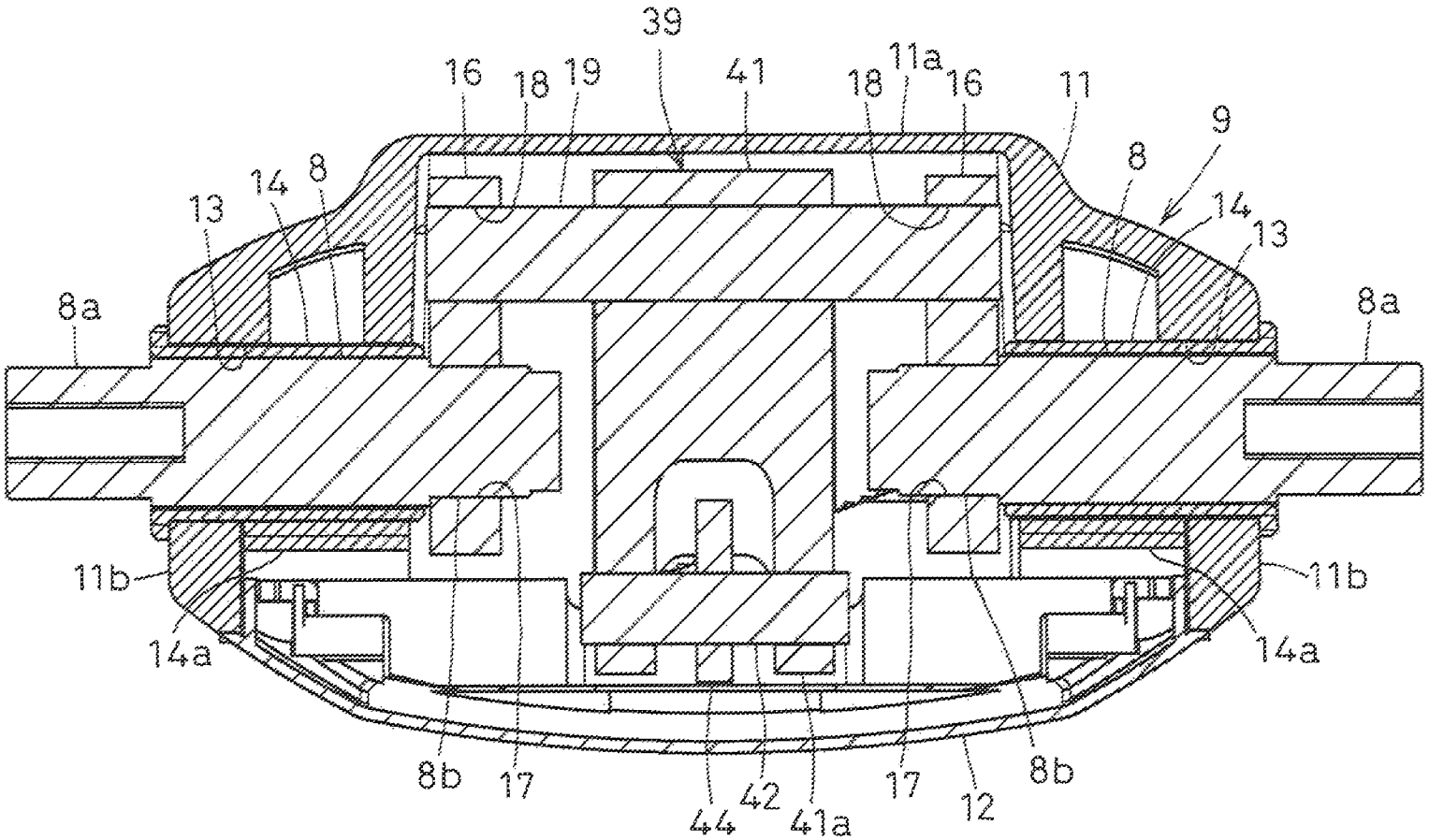
FIG. 7 is a vertical sectional front view taken along the line VII-VII in FIG. 6.

The chair comprises a leg unit 3 comprising five radially-arranged legs 2 each of which has a caster 1; a telescopic column 5 which stands on the leg unit 3 and houses a gas spring 4 therein (in FIGS. 3 and 14); a base 6 which is supported at the rear end on the column 4 and inclined forward and upward; a seat 7 supported as below; a pair of backrest support rods 9,9 pivotally mounted to the base 6 via a pair of pivot shafts 8,8 (in FIGS. 3 and 7) at the front end; and a backrest 10 supported by the rear ends of the backrest support rods 9,9.

The backrest 10 is pivoted together with the right and left backrest support rods 9,9 and the pivot shafts 8,8 from an upright position on the rear of the seat 7 in FIG. 2 to a suitable rearward-inclined position (not shown) about an axis of the pivot shafts 8,8.

In FIGS. 4 to 21 the base 6 made of rigid synthetic resin comprises a pentagonal base body 11 like a baseball home plate which is a bottom opening, and a lower cover made of rigid synthetic resin which detachably closes the lower opening of the base body 11. Under the base body 11, a number of parts are attached in the base 6.

Through side portions 11*b*,11*b* suspending from an upper portion 11*a* of the base body 11, there are formed holes 13,13 in the same line at the rear part, and a bush 14 fits in the each of the holes 13. The bush 14 is held with the upper portion 11*a* of the base body 11 and a gland 14*a* screwed on the lower surface of the upper portion 11*a*.

On the inner and outer ends of each of the pivot shaft 8, there are formed rectangular portions 8*a*,8*b*. The outer rectangular portion 8*a* engages in a rectangular hole 16 at the front end of each of the backrest support rods 9, and the inner rectangular portion 8*b* engages in a rectangular hole 17 of each of a pair of rotary members 16, 16 in the base 6.

Each end of a connecting rod 19 fits in an engagement hole 18 over the rectangular hole 17 at an eccentric part of the rotary member 16. Each end of the connecting rod 19 may turn in the engagement hole 19 or may be fixed to the rotary member 16.

Thus, the backrest 10, backrest support rods 9,9, pivot shafts 8,8, rotary members 16,16 and connecting rod 19 turn together around an axis of the pivots shafts 8,8.

Figure 8:
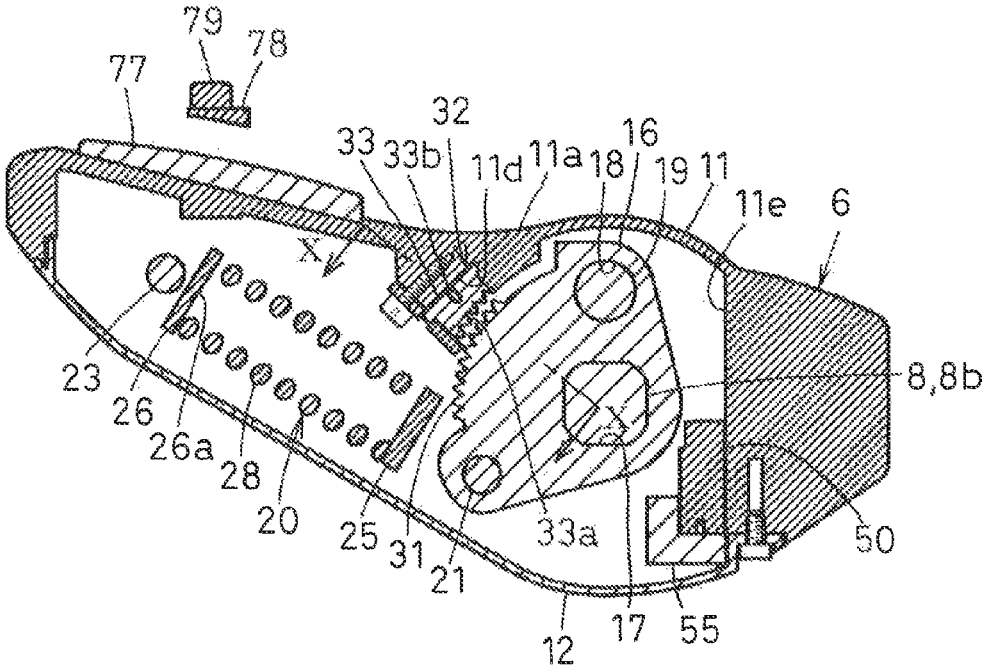
FIG. 8 is a vertical sectional view taken along the line VIII-VIII in FIG. 6, illustrating the inside of the base when the backrest is unlocked.

There is provided a pair of biasing means 20,20 for applying the rotary members 16 in a direction for standing up the backrest 10 or counterclockwise in FIG. 8 between an eccentric portion in front of the rectangular hole 17 and the front part of the base 11.

In FIGS. 4-13, the first biasing means 20 comprises a spring-guide plate 24 inclined forward and upward, the rear end of the plate 24 being coupled to the rotary member 16 with a transverse shaft 21, a transverse shaft 23 in the base body 11 being disposed in an elongate hole 22 of the plate 24; a spring-bearing plate 25 fixed to the rear end of the guide plate 24; a spring retainer 26 in which the shaft 23 fits in through holes 26*c*,26*c* of the side portions 26*b*26*b* such that the spring guide plate 24 puts through a slit 27 (FIG. 20) in the middle of the spring-bearing surface 26*a*; and a compression spring 28 compressed between the spring-bearing plate 25 and the spring-bearing surface 26*a* of the spring retainer 26 and biasing the front end of the rotary member 16 backward and downward by storing a reaction force under compression.

The shaft 23 has a length approximately equal to a distance between the side portions 11*b* and 11*b* of the base body 11 and engages in an inverted U-shaped groove 29 in two ribs 11*c*, 11*c* longitudinally on the lower surface of the upper portion 11*a* of the base body 11. The shaft 23 is attached with a shaft holder 30 on the front part in the base rotatably (unrotatably may be accepted) by holding it on the lower surface of each of the ribs 11*c*.

Figure 12:
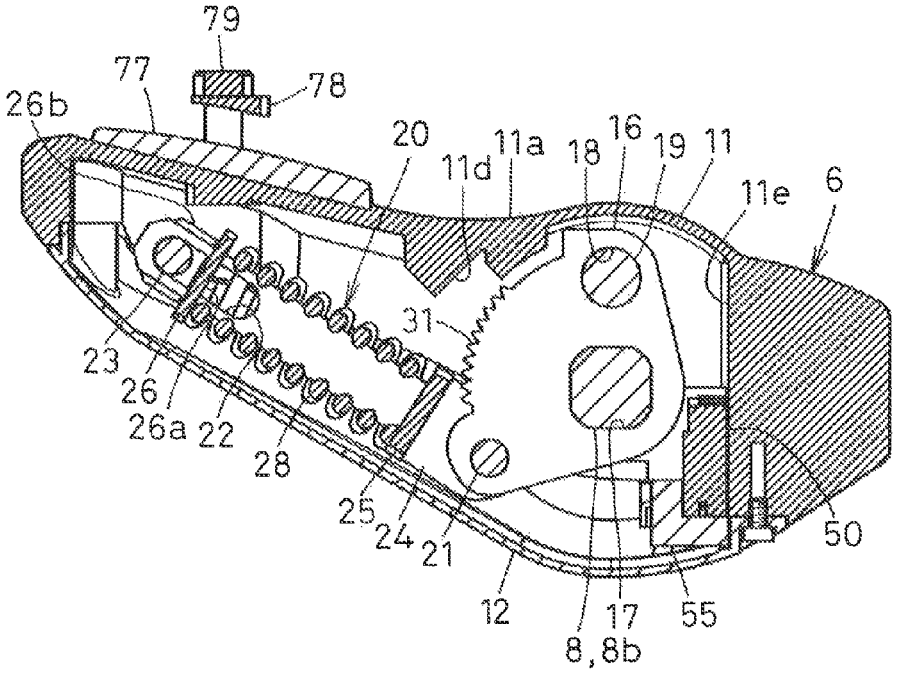
FIG. 12 is a vertical sectional side view taken along the line XII-XII in FIG. 6, illustrating the inside of the base when the backrest is upright.
Figure 13:
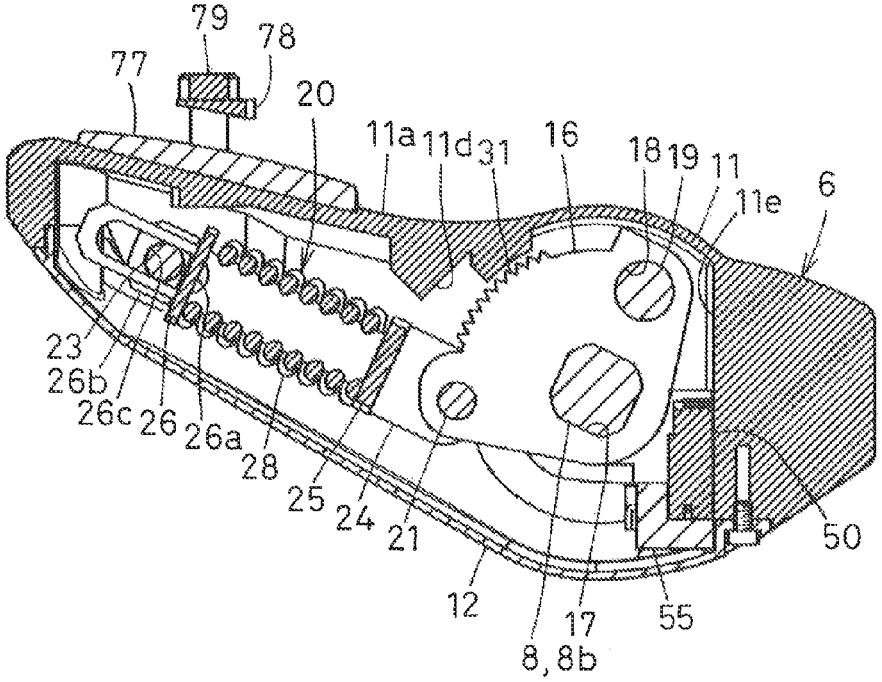
FIG. 13 is a sectional view similar to FIG. 12, illustrating the inside of the base when the backrest is inclined backward.

In FIG. 12, when the shaft 23 is in contact with the front end of the elongate hole 22 of the spring-guide plate 24, the rear end of the spring guide plate 24 does not move backward further, thereby preventing the rotary member 16 from turning counterclockwise in FIG. 12 and the backrest 10 forward from the upright position. In FIG. 13, with backward inclination of the backrest 10, the rotary member 16 is turned clockwise around the pivot shaft 8, and the spring guide plate 24 is pushed up forward within the range in which the elongate hole 22 can move with respect to the shaft 23. The compression spring 28 is compressed to apply a biasing force to the rotary member 16 in a direction where the backrest 10 is upright.

On the outer arcuate circumferential surface of the right and left rotary members 16,16, there are formed teeth 31 like a part of a spur gear. With the teeth 31 of one of the rotary members 16,16 is provided a locking device 32 for the backrest 10.

The locking device 32 comprises a locking member 33 having teeth 33*a* on its lower surface. The teeth 33*a* can engage with the teeth 31 of the right rotary member 16 viewed from front.

Figure 10:
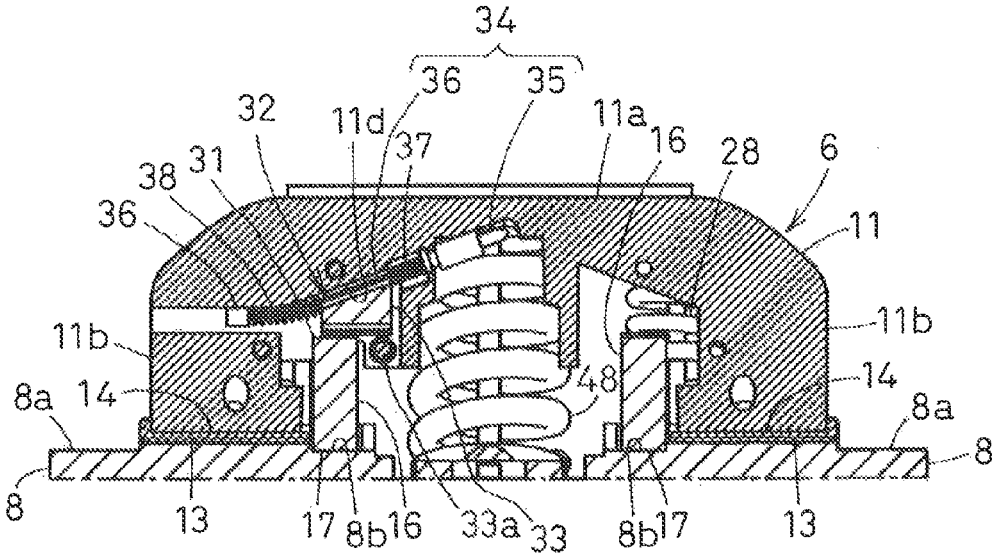
FIG. 10 is a sectional view taken along the line X-X in FIG. 8, illustrating the inside of the base when the backrest is unlocked.
Figure 11:
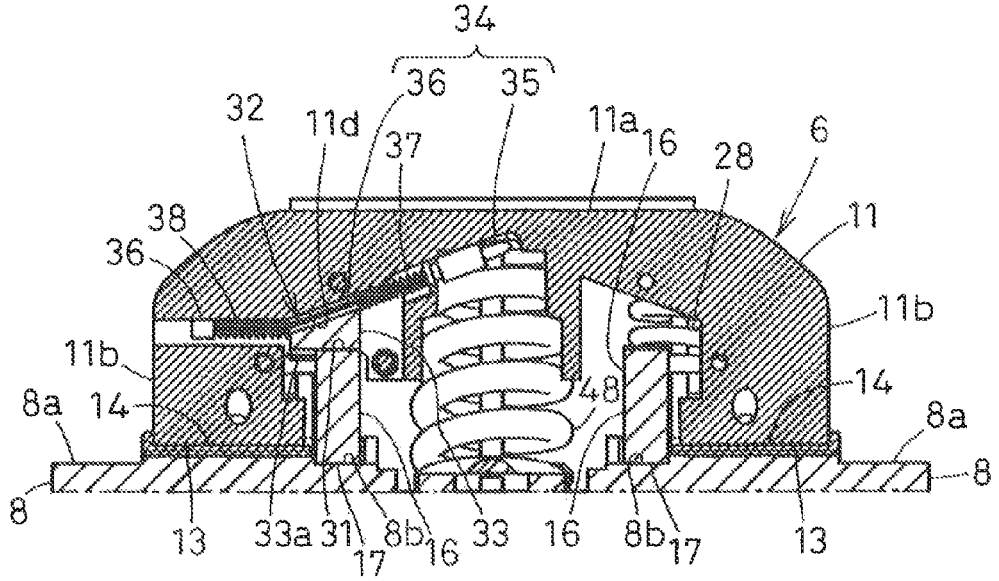
FIG. 11 is a sectional view similar to FIG. 10, illustrating the inside of the base when the backrest is locked.

In FIGS. 10 and 11, the locking member 33 moves obliquely between a locked position in which the teeth 33*a* mesh with the teeth 31 of the rotary member 16 in FIG. 11 and an unlocked position in which the teeth 33*a* leave the teeth 31 of the rotary member 16 in FIG. 10 along a guide portion 11*d* on the lower surface of the upper portion 11*a* of the base body 11.

The locking member 33 is connected to operating means (later described) via a Bowden cable.

The Bowden cable 34 comprises a flexible outer tube 35 mounted at one end outward and downward to the upper end of the guide portion 11*d* and at the other end to a case of the operating means; and an inner wire 36 pulled out of one end of the outer tube 35 obliquely downward through a wire-through portion 33*b* at the upper end of the locking member 33 and mounted to a wire end member 36*a*.

Between the locking member 33 and one end of the outer tube 35 and between the locking member 33 and the wire end member 36*a*, compression springs 37,38, preferably having the same spring constant, are compressed to surround the inner wire 36.

In FIG. 11 when the locking member 33 is in the locking position, the inner and outer compression springs 37,38 are balanced to each other, and the locking member 33 is held in the locking position. When the inner wire 36 is pulled in by the operating means, the two compression springs 37,38 are compressed. When load is not applied to the backrest 10, the locking member 33 is moved to the unlocking position in FIG. 10 with balance of the forces by the compression springs 37,38, so that the backrest 10 can be pivoted freely.

When load is applied to the backrest 10 not to disengage the teeth 32 of the locking member 33 from the teeth 31 of the rotary member 16, the inner wire 36 is pulled by the operating means, and the outer compression spring 38 is only compressed. Thereafter, when the backrest is unloaded, the locking member 33 is moved by the force of the compression spring 38 to the unlocking position in FIG. 10 balancing the forces of the compression springs 37,38.

In FIGS. 6, 7 and 14-19, between the connecting rod 19 and the base 6, there is provided second biasing means 40 with biasing-force adjusting means for applying a biasing force to the connecting rod 19 and right and left rotary members between the right and left rotary members 16 and 16 and between the first biasing means 20 and 20.

The second biasing means 40 is similar to the first biasing means 20 except the biasing-force adjusting means.

The second biasing means 40 comprises a biasing-force transmitting member 41 pivotally mounted to the connecting rod 19 and suspending therefrom as part of the biasing-force adjusting means 39; a spring-guide plate 44 inclined forward and upward, engaging in a forked portion 41*a* under the lower end of the biasing-force transmitting member 41 with a shaft 42, and having an elongate hole 43 at the front end in which the shaft 23 engages; a spring-bearing plate 45 fixed to the rear part of the spring guide plate 44; a spring retainer 46 in which the shaft 23 engages in the through holes 46*c*,46*c* of side portions 46*b*,46*b* such that the spring guide plate 44 is disposed in a slit 47 (in FIG. 14) of a spring-retaining surface 46*a*; and a compression spring 48 compressed between the spring-retaining plate 45 and spring-retaining surface 46*a* of the spring retainer 46 around the spring-guide plate 44 to bias the lower end of the biasing-force transmitting member 41 backward by storing a reaction force under compression.

The compression spring 48 is larger in a spring constant than the compression spring 28.

In FIGS. 4,5 and 14-17, between the biasing-force transmitting member 41 in the base 6 and the front surface of a vertical wall 11*e* suspending from the rear end of the upper portion 11*a* of the base 11, the biasing-force adjusting means 39 is provided.

The biasing-force adjusting means 39 comprises the biasing-force transmitting member 41; a fulcrum member 49 which can come in contact with and move along the rear surface of the biasing-force transmitting member 41 vertically; and a moving member 50 for moving the fulcrum member 49 along the rear surface of the biasing-force transmitting member 41. The biasing-force transmitting member 41 acts as a lever having as the fulcrum which is a contact point with the fulcrum member 49. A biasing force of the second biasing means 40 exerting the end as the point of effort is reversed. By the base end as the point of action, the connecting rod 19 and rotary member 16 are biased in a direction for standing up the backrest 10.

Figure 16:
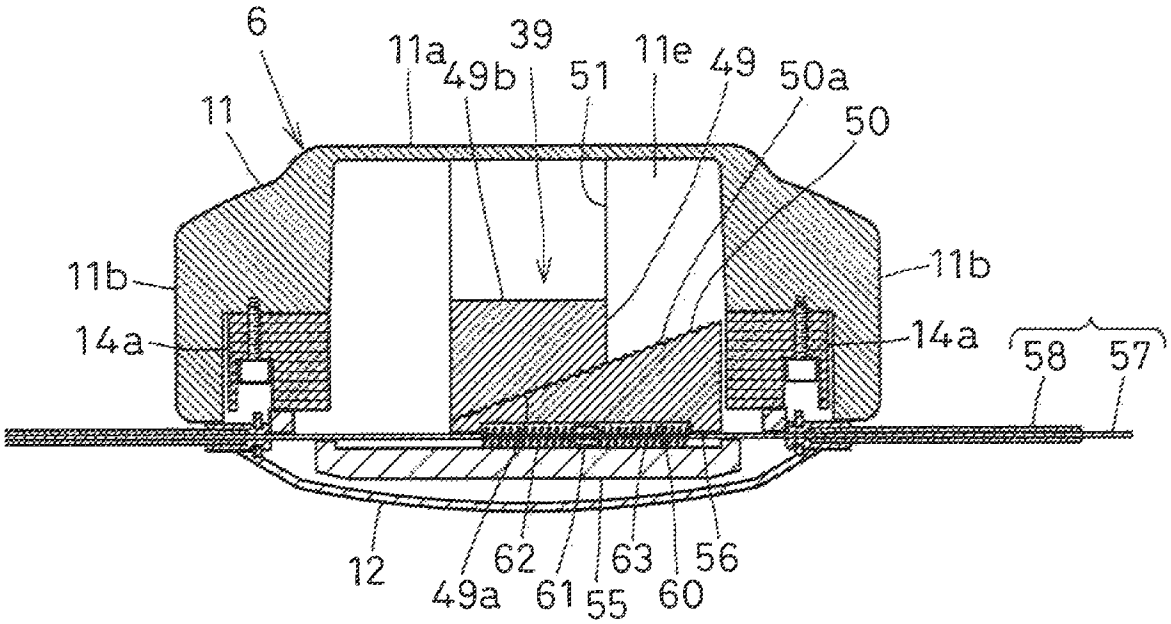
FIG. 16 is a vertical sectional front view taken along the line XVI-XVI in FIG. 6, illustrating the inside of the base when the biasing force of the backrest is weak.

A lower surface 49*a* of the fulcrum member 49 is inclined rightward and upward in FIG. 16, and an upper surface 49*b* is horizontal. Between the upper surface 49*b* and the front surface 49*c*, there is formed an inclined surface 49*d* forward and downward. A corner between the inclined surface 49*d* and the front surface 49*c* is a contact portion 49*e* with the back surface of the biasing-force transmitting member 41. The contact portion 49*e* may preferably be arcuate viewed from an axis of the pivot shaft 8.

The back of the fulcrum member 49 vertically slides in a shallow vertical groove 51 in the middle of the front surface of the vertical wall 11*e* of the base body 11.

The lower surface 49*a* of the fulcrum member 49 is disposed on an upper surface 50*a* of the moving member 30 as a right triangle. The moving member 50 horizontally moves in FIG. 16, and the lower surface 49*a* of the fulcrum member 49 slides along the upper surface of the moving member 50, so that the fulcrum member 49 moves along the groove 51 vertically.

Figure 14:
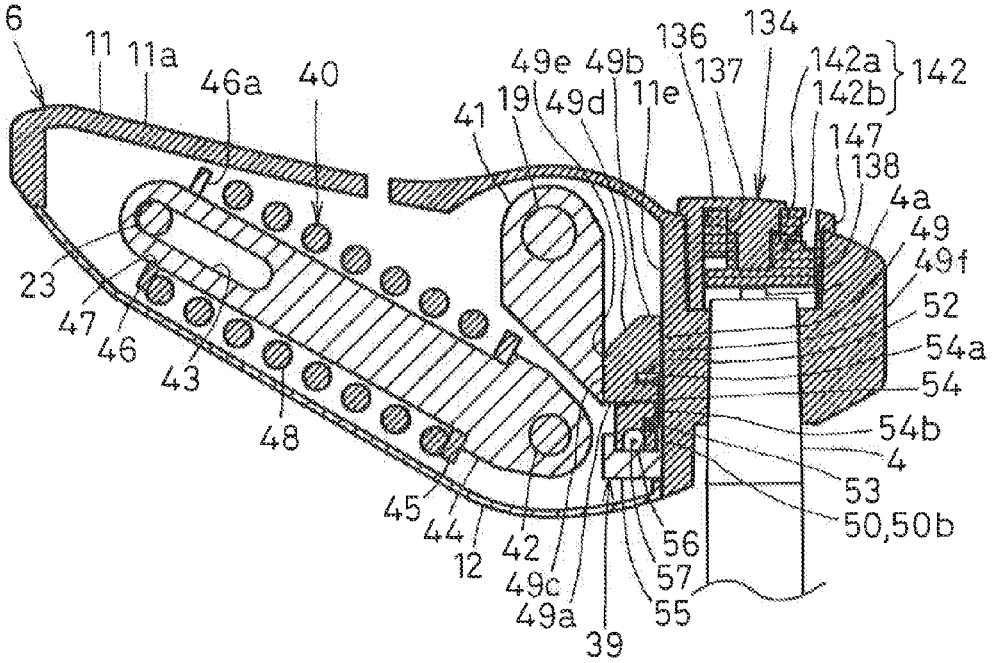
FIG. 14 is a vertical sectional view taken along the line XIV-XIV in FIG. 6, illustrating the inside of the base when a biasing force of the backrest is weak.
Figure 15:
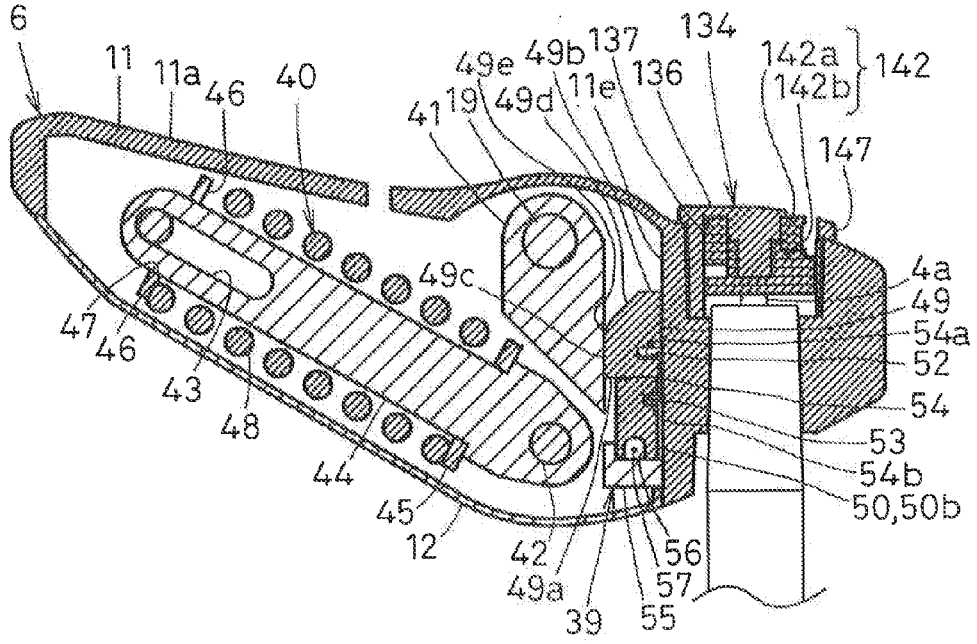
FIG. 15 is a vertical sectional view similar to FIG. 14, illustrating the inside of the base when the biasing force of the backrest is strong.

In order that the fulcrum member 49 may move down securely with movement of the moving member 50 rightward, in FIGS. 14 and 15, at the lower part of a back surface 49*f* of the fulcrum member 49, there is formed a short recess 52 in parallel with the lower surface 49*a*, and there is formed a long recess 53 in parallel with the upper surface 50*a* at the upper part of a back surface 50*b* of the moving member 50. In the grooves 52,53, a forward and downward upper portion 54*a* and a forward and upward lower portion 54*b* of a leaf spring 54 engage. The leaf spring 54 elastically holds a part between the grooves 52 and 53 thereby preventing the fulcrum member 49 from leaving the moving member 50.

Minute waves are applied to the lower surface of the fulcrum member 49 and the upper surface 50*a* of the moving member 50 to prevent the moving member 50 from moving horizontally without reason.

However, in order that the upper surface of the moving member 50 may slide on the lower surface of the fulcrum member 49, the ends of the upper portion 54*a* and lower portion 54*b* are elastically deformed to expand vertically so as to allow up-and-down motion of the fulcrum member 49 over the moving member 50 in which the waves on the upper surface 50*a* of the moving member 50 go over the waves on the lower surface 49*a* of the fulcrum member 49.

The lower surface of the moving member 50 slides over the upper surface of the guide member 55 fixed to the front surface of the lower end of the vertical wall 11*e* of the base 11.

At the lower end of the moving member 50, a wire-through groove 56 is formed across the chair, and a closed-loop inner wire 37 connected to the operating means (later described) runs through the wire-through groove 56.

The inner wire 57 extends sideward beyond the right and left ends of the guide member 55 from the wire-through groove 50 into the flexible outer tubes 58,58 the end of which is mounted to a position spaced from the guide member 55.

The other ends of the outer tubes 58,58 are mounted to the case for the operating means (later described), and the inner wire 57 pulled out is pushed and pulled axially.

The closed-loop inner wire 57 and the pair of outer tubes 58,58 constitute the Bowden cable 59.

Above the wire-through groove 56, a spring-housing portion 60 is formed and is continuous with the wire-through groove 56. In the middle of the spring-housing portion 60, a cylindrical spring retainer 61 is fixed to the inner wire 57. Between the left end face of the spring retainer 61 and the left end of the spring-housing portion 60 and between the right end face of the spring retainer 61 and the right end of the spring-housing portion 60, compression springs 62,63 are provided around the inner wire 57.

When the moving member 50 is unloaded, the moving member 50 is held at a position such that the right and left compression springs 62,63 may be balanced with respect to the spring retainer 61.

In FIG. 16, when the inner wire 57 is pulled leftward by the operating means, the moving member 50 is moved leftward with the leftward motion of the spring retainer 61 while the left compression spring 62 is compressed. The fulcrum member 49 is pushed up on the upper surface 50*a* of the moving member 50 in FIG. 17.

Figure 17:
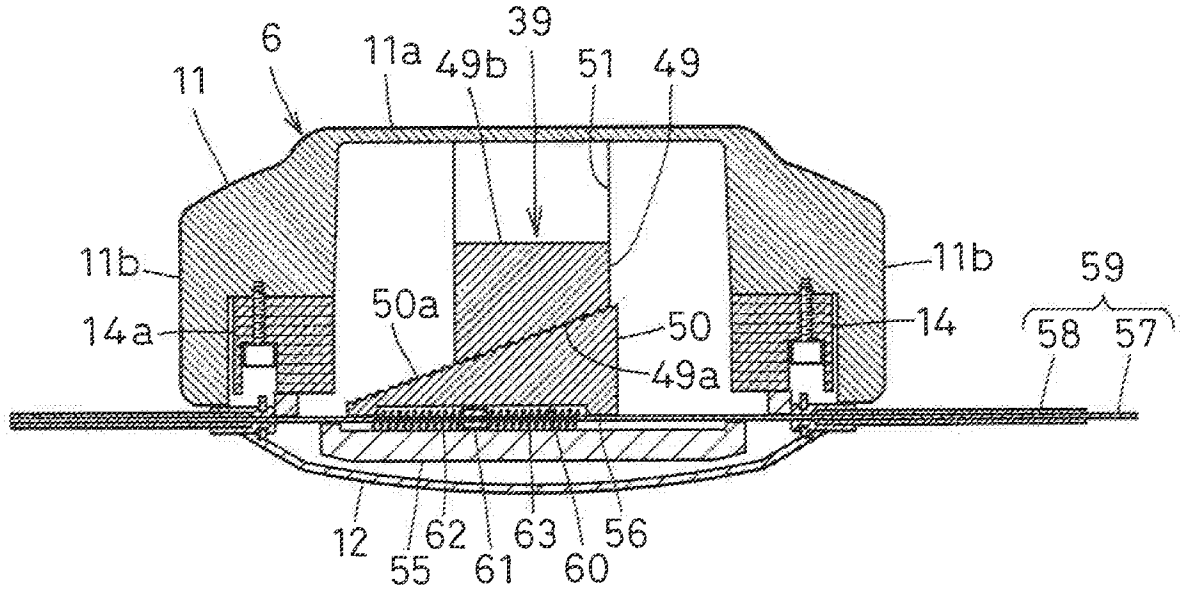
FIG. 17 is a vertical sectional front view similar to FIG. 16, illustrating the inside of the base when the biasing force of the backrest is strong.

In FIG. 17, when the inner wire 57 is pulled rightward by the operating means, the moving member 50 is moved leftward with rightward motion of the spring retainer 61 while the compression spring 63 is compressed, so that the fulcrum member 49 lowers.

When the backrest 10 is in an upright position and the front end of the elongate hole 43 of the spring guide plate 44 is in contact with the shaft 23, the spring guide plate 44 prevents the lower end of the biasing-force transmitting member 41 from turning backward further.

The back surface of the biasing-force transmitting member 41 is parallel with the front surface of the vertical wall 11*a* of the base 11, and the fulcrum member 49 is slightly spaced from the back surface of the biasing-force transmitting member 41. Alternatively, the fulcrum member 49 may preferably be in contact with the back surface of the biasing-force transmitting member 41 such that the biasing force of the compression spring 48 does not exerts the fulcrum member 49.

Then, the second biasing means 4, biasing-force adjusting means 39 therefor and all the members in the base 11 will be described on function.

Figure 9:
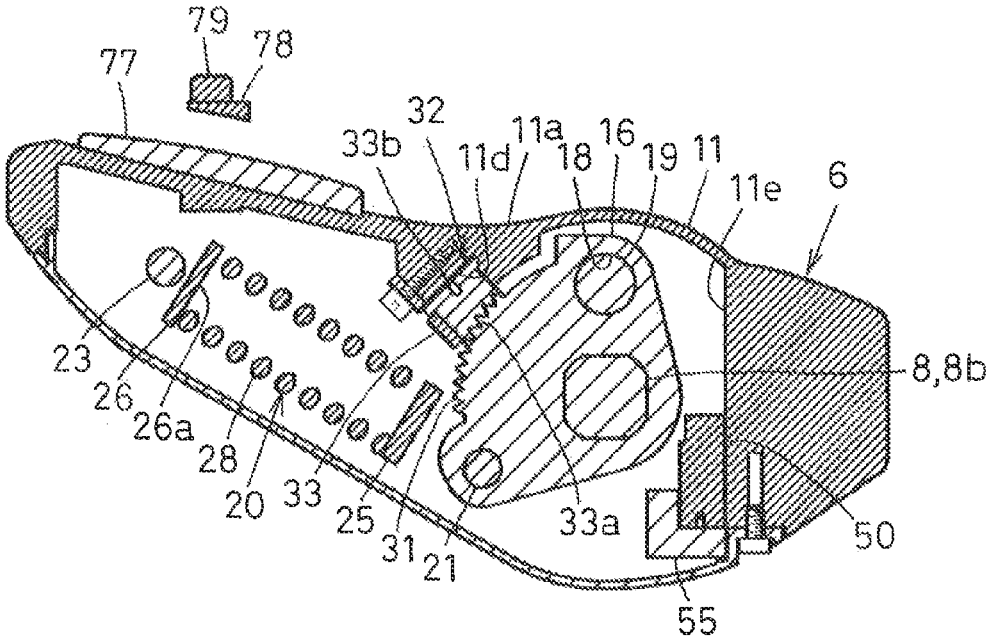
FIG. 9 is a vertical sectional view similar to FIG. 8, illustrating the inside of base when the backrest is locked.

When the backrest 10 is in the upright position, the right and left rotary member 16,16 are in a rest position in FIGS. 8, 9 and 12. The rotary member 16 and backrest 10 are prevented from turning counterclockwise by contacting the shaft 23 with the front end of the elongate hole 22 of the spring guide plate 24.

In FIGS. 14 and 15, the biasing-force transmitting member 41 suspends under the connecting rod 19. The lower end of the biasing-force transmitting member 41 is prevented from further turning backward by contacting the shaft 23 with the front end of the elongate hole 43 of the spring-guide plate 44.

Hence, the fulcrum member 49 of the biasing-force adjusting means 39 can be moved up and down by a weak force.

In FIGS. 9 and 11, the locking device 32 is usually in a lock state in which the teeth 33*a* of the locking member 33*a* engage with the teeth 31 of the left rotary member 16.

By operating means of the locking device 32, the inner wire 36 is pulled, and the locking member 33 is moved inward and upward off the rotary member 16. The teeth 33*a* disengages from the teeth 31 of the rotary member 16 in the unlocking state.

The back of the occupant is leaned over the backrest 10, and the backrest 10 can be reclined backward.

When the backrest 10 is inclined backward in FIG. 13, the right and left rotary members 16,16 and connecting rod 19 turn clockwise around an axis of the pivot shaft 8 together with the backrest 10. The right and left guide plates 24,24 are pushed up forward with movement of the shafts 21,21, and the compression springs 28,28 are compressed. The reaction force is applied to the rotary members 16,16 as biasing force of the first biasing means 20,20 to make the backrest return to the upright position.

With turning of the connecting rod 19, the upper end of the biasing-force transmitting member 41 is turned backward and downward on the contacting portion 49*e* of the fulcrum member 19 as the fulcrum, and the lower end of the biasing-force transmitting member 41 is turned forward. The spring guide plate 44 is pushed up forward via the shaft 42, and the reaction force exerts the rotary members 16,16 as biasing force for the second biasing means to return the backrest 10 to the upright position.

Figure 18:
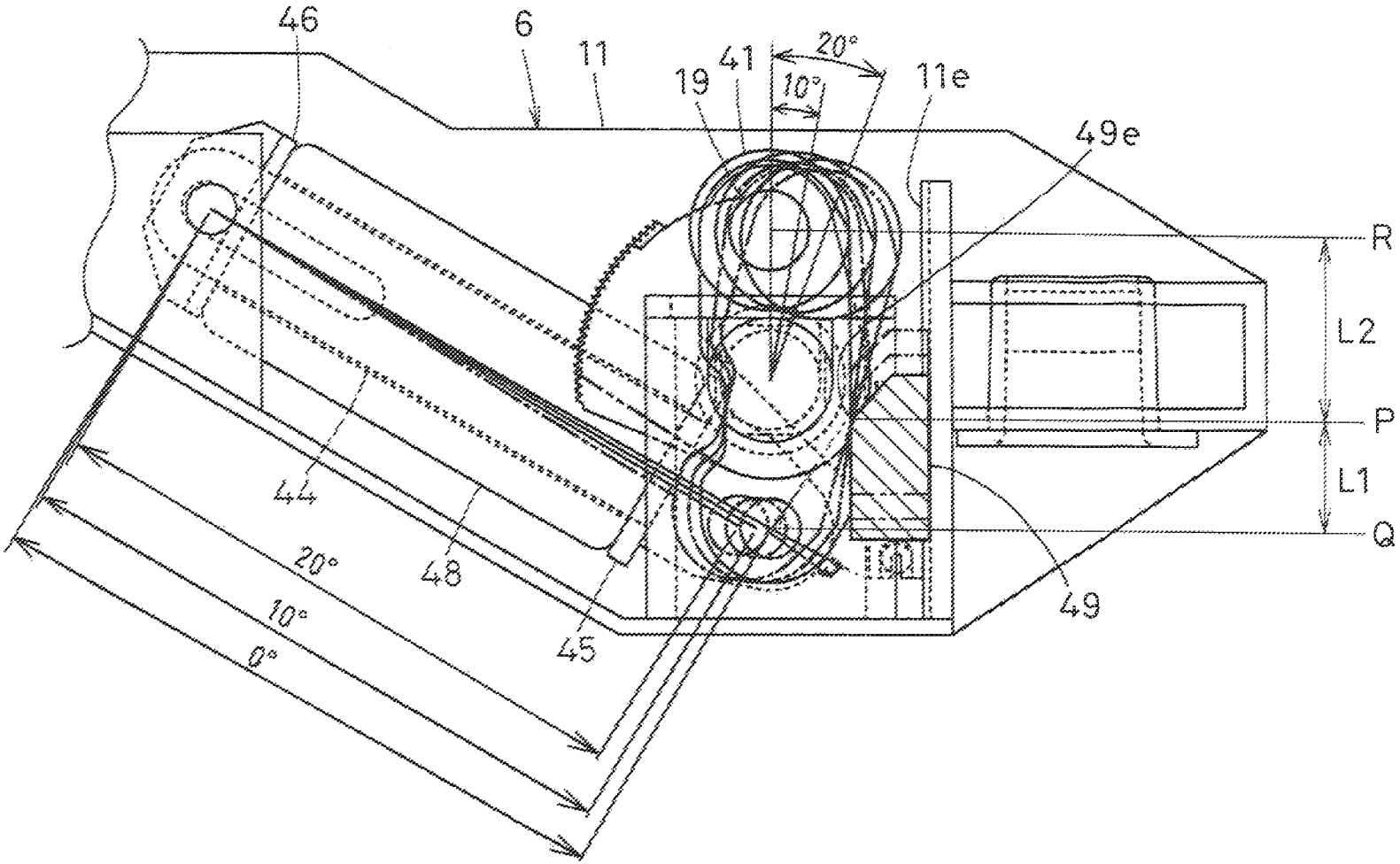
FIG. 18 is a view showing motion of a biasing-force transmitting member when the biasing force of the backrest is weak.

When the fulcrum member 49 is in a lower limit in FIG. 18, a distance L1 from the fulcrum to the point of effort L1 is smaller than a distance L2 from the fulcrum to the point of action. Hence, the biasing force of the second biasing means 40 is slightly transmitted to the rotary members 16,16 and the backrest 10 via the connecting rod 19. Thus the returning force of the backrest 10 becomes weak.

Figure 19:
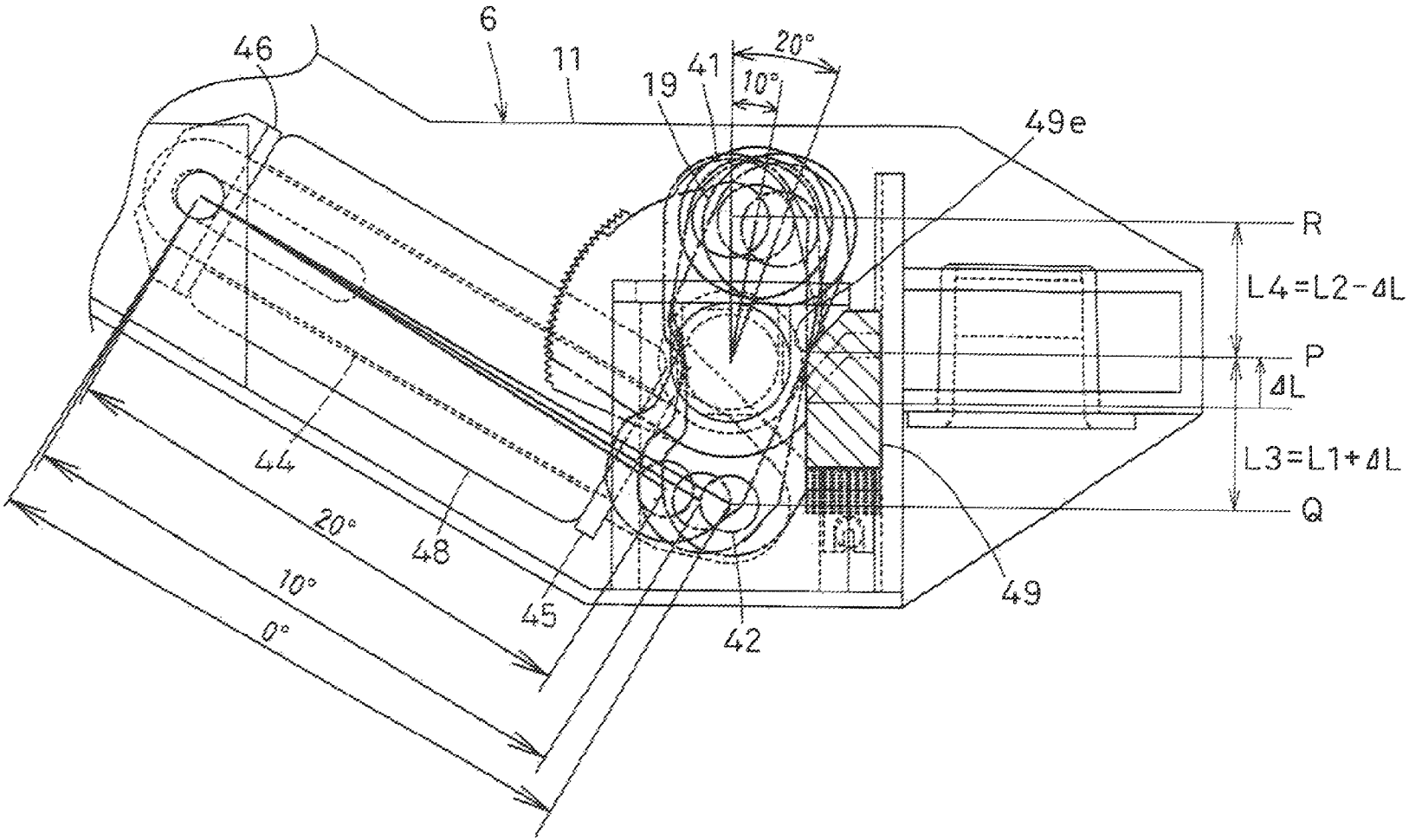
FIG. 19 is a view showing motion of the biasing-force transmitting member when the biasing force of the backrest is strong.

In FIG. 19, when the fulcrum member 49 is raised from the lower limit by $\Delta L$, a distance L3 from the fulcrum P to the point of effort becomes $L1+\Delta L$, and a distance $L2-\Delta L$. A lot of biasing force of the second biasing means 40 is transmitted to the rotary members 16,16 and the backrest 10. The returning force of the backrest 10 becomes stronger.

In the biasing-force transmitting member 41, the difference between the distance La from the fulcrum P to the point of effort Q and the distance from the fulcrum to the point of action changes twice of a moving distance of the fulcrum member 41. By moving the fulcrum member 41 slightly, biasing force exerting the backrest 10 can be changed greatly. Hence, the whole device can be made smaller. The biasing force acting on the backrest 10 can continuously be adjusted.

Because the contact portion 49*e* to the biasing-force transmitting member 41 is arcuate when viewed axially, the biasing-force transmitting member can be turned smoothly on a contact point with the fulcrum member 49. The contact point is moved on the arcuate surface of the contact portion 49*e* of the fulcrum member 49 depending on a rotary angle of the biasing-force transmitting member 41. Wear does not gather locally thereby enhancing durability. By utilizing that the contact point moves with a turning angle of the biasing-force transmitting member 41, the biasing force transmitted to the backrest 10 is increased with backward inclination of the backrest 10.

The connecting rod 19 is coupled above the pivot shaft 8 of the right and left rotary members 16,16. The biasing-force transmitting member 41 suspends from the connecting rod 19, and the second biasing means 30 is disposed at the lower end of the biasing-force transmitting member 41. The biasing-force transmitting member 41 and the right and left rotary members 16,16 overlap across the chair. Hence, the right and left rotary members 16,16, biasing-force transmitting member 41, right and left first biasing means 20,20 and second biasing means 40 overlap across the chair and can be housed in a small space.

The backrest 10 can smoothly be biased in a good balance by a plurality of biasing means. The biasing force exerting the backrest 10 can effectively be adjusted without losing balance. Furthermore, a plurality of biasing means can be housed in a small space.

Then, how to mount the seat 7 to the base 6 will be described with respect to FIGS. 1-3 and FIGS. 20-30.

The seat 7 comprises a seat-holding frame 70; a synthetic-resin seat plate 71 mounted to the seat-holding frame 70; and a cushion 62 mounted to the seat plate 71 to cover the upper surface and outer circumferential surface of the seat plate 71.

The seat-holding frame 70 is made of rigid synthetic-resin rectangular frame and comprises a pair of guide rods 73,73; a front connecting rod 74 for connecting the front ends of the guide rods 73,73 to each other; and a back connecting rod 75 for connecting the back ends of the guide rods 73,73.

A pair of elongate holes 76,76 is formed in the front connecting rod 74.

Figure 3:
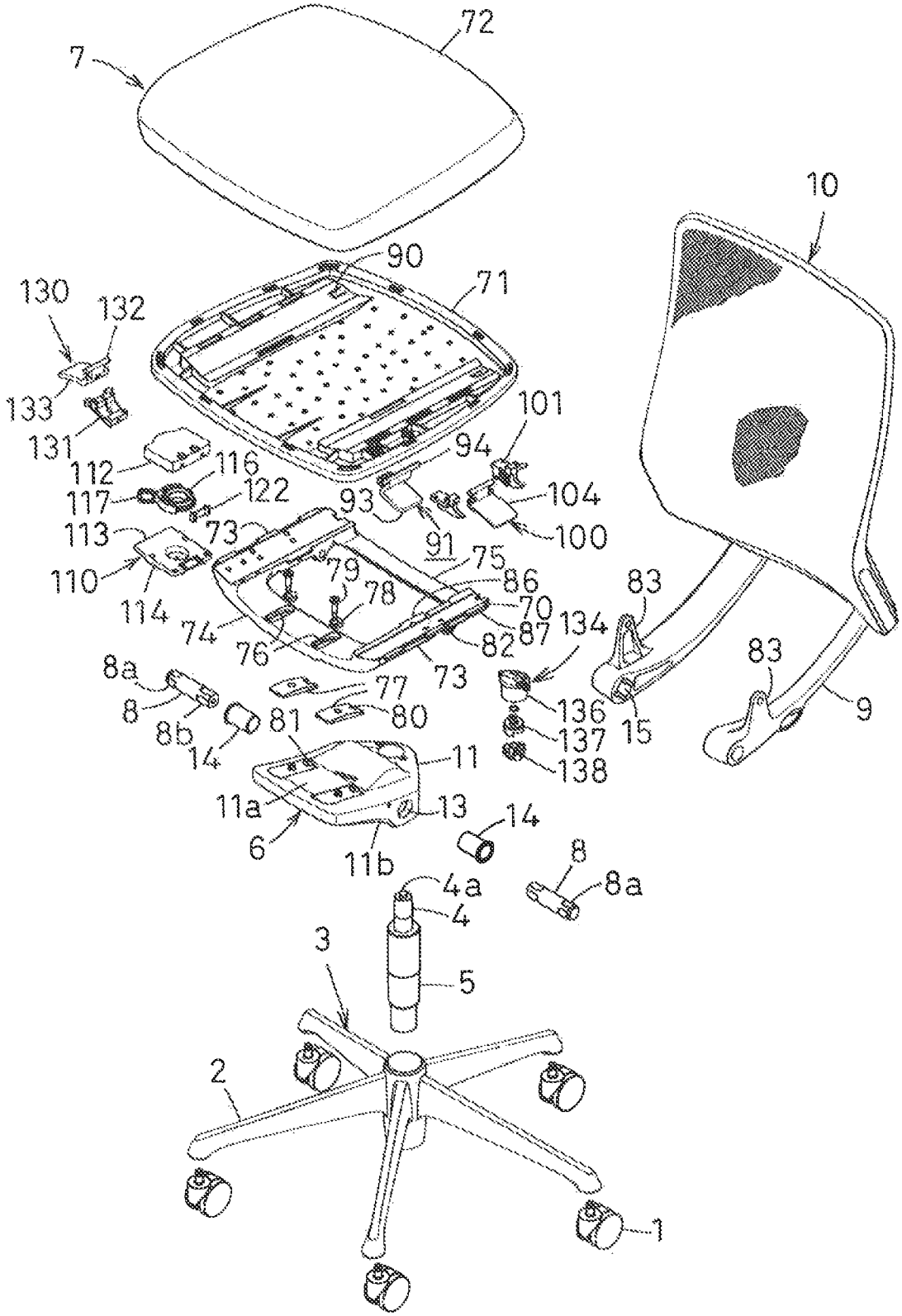
FIG. 3 is an exploded perspective view thereof.
Figure 4:
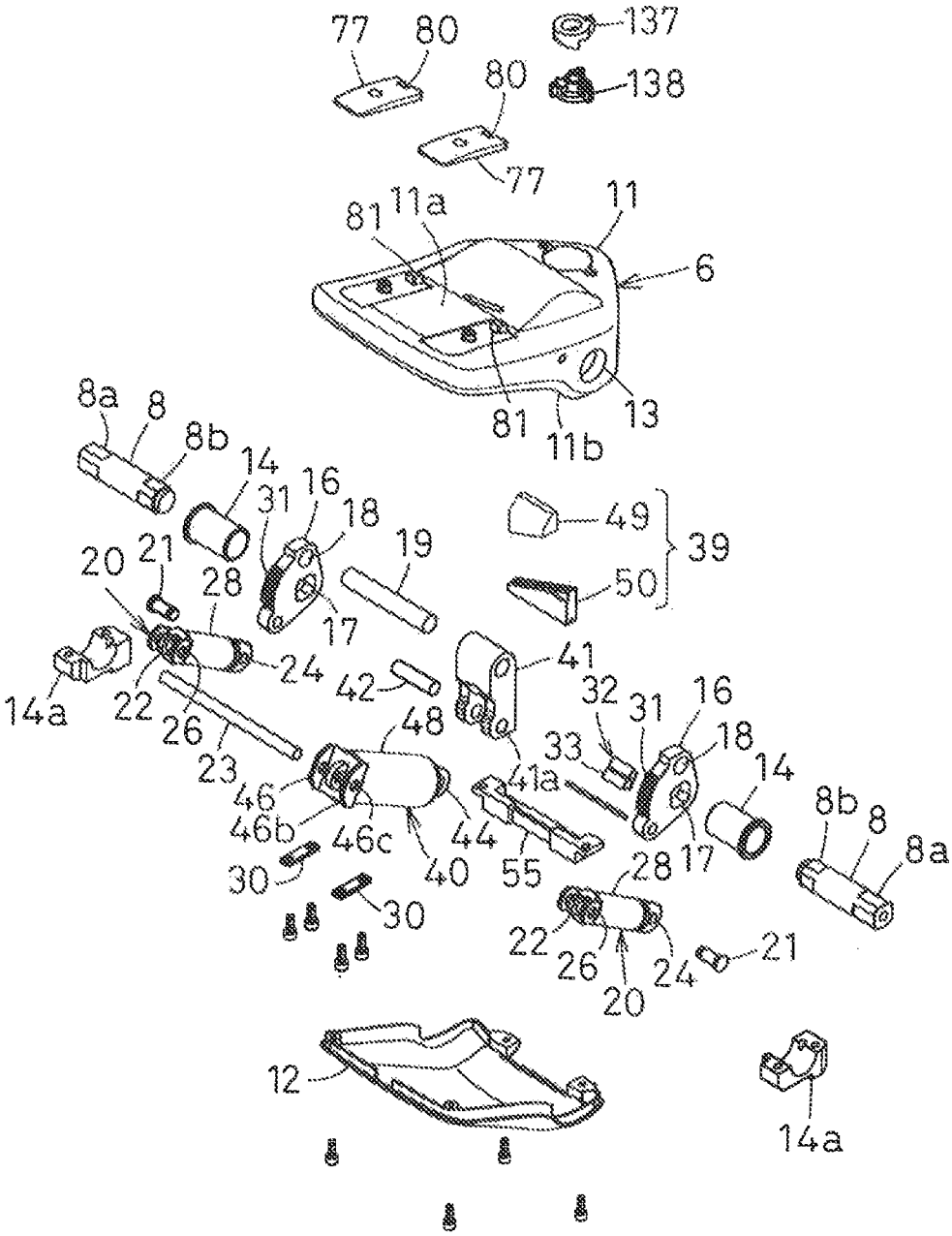
FIG. 4 is an exploded perspective view of a base viewed from above.
Figure 5:
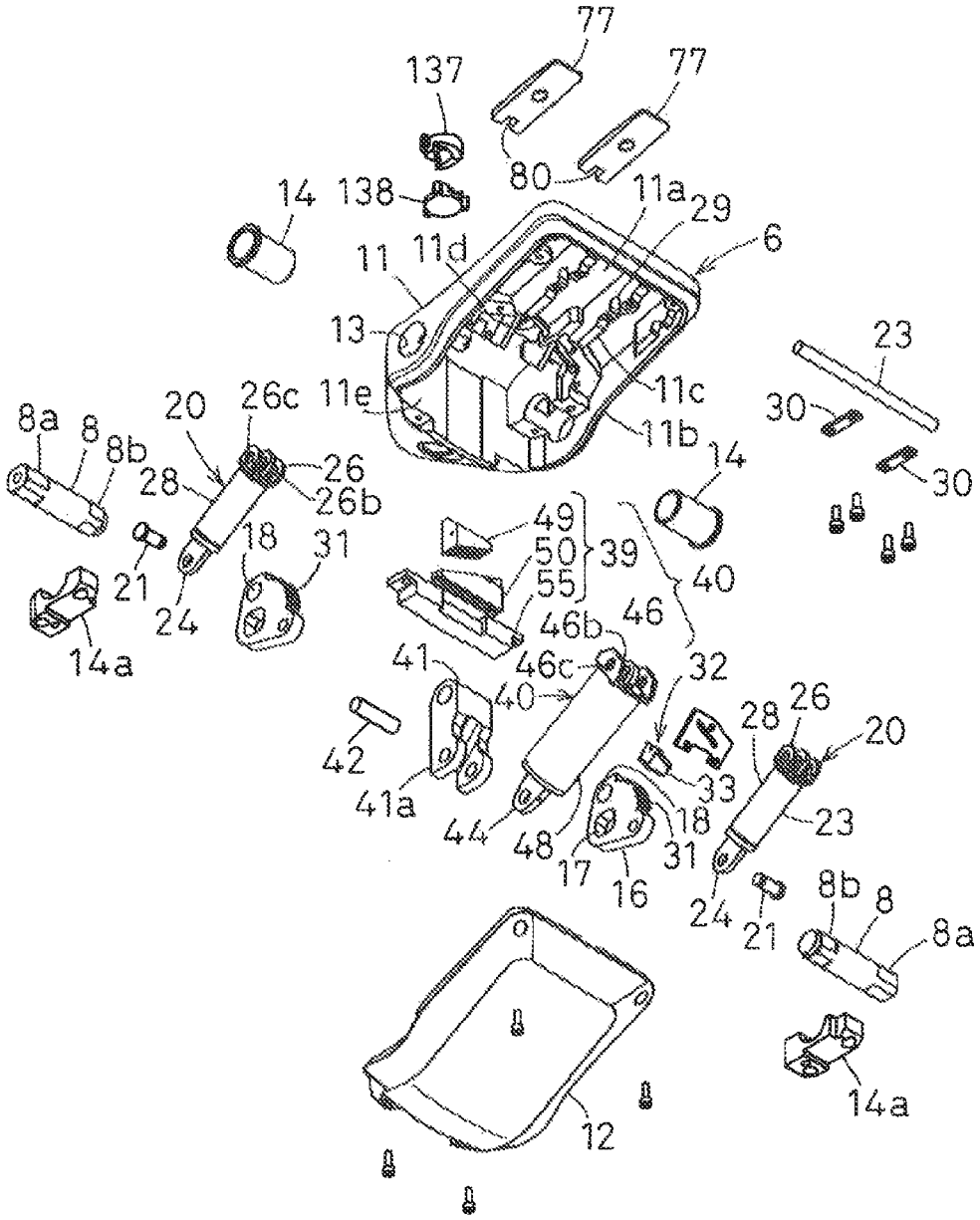
FIG. 5 is an exploded perspective view viewed from below.
Figure 6:
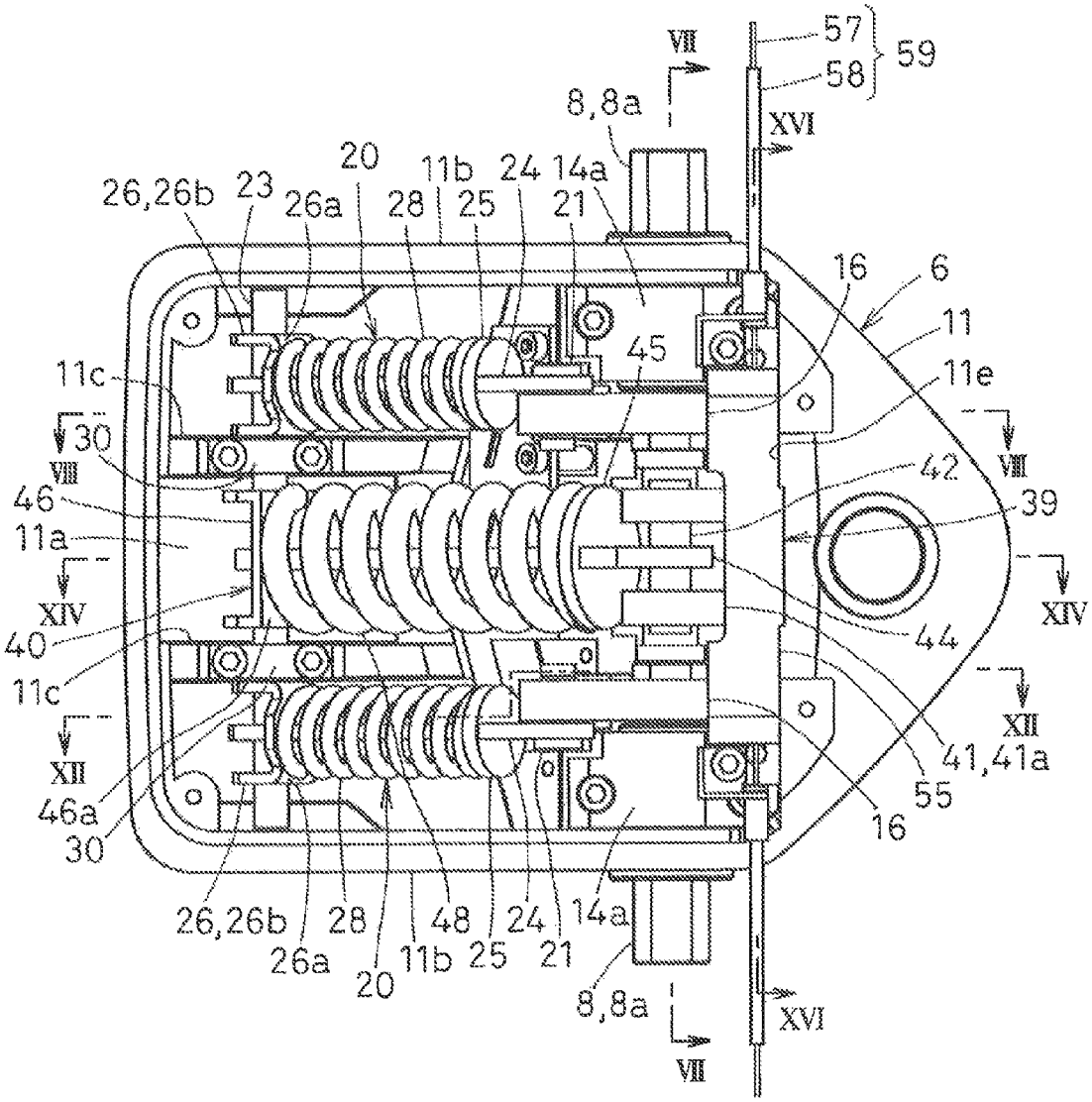
FIG. 6 is a bottom plan view of the base without a lower cover.
Figure 20:
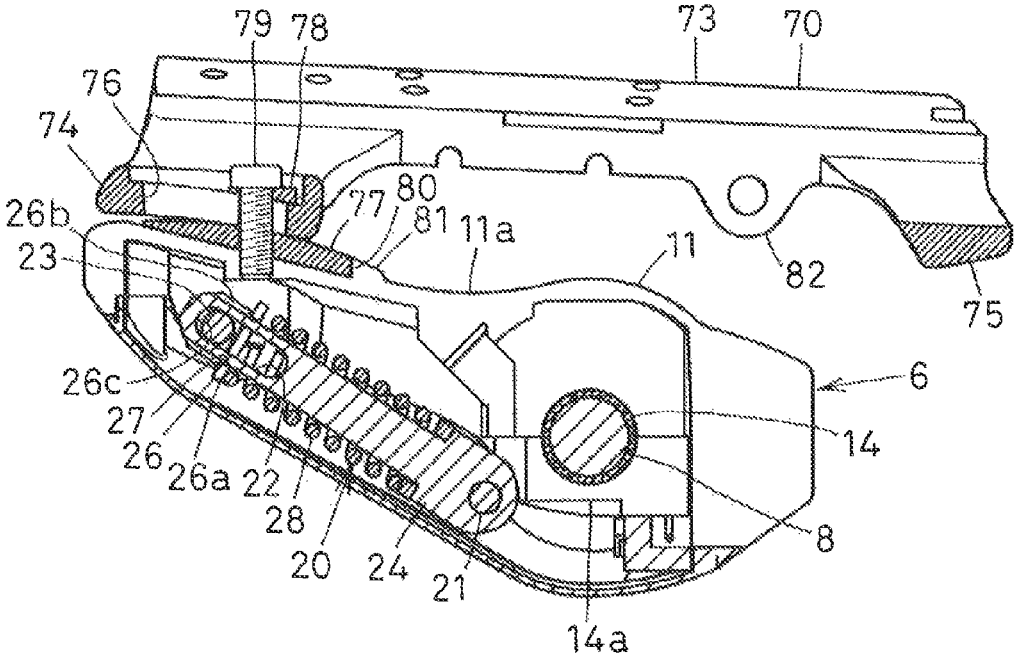
FIG. 20 is a vertical sectional side view taken along the line XX-XX in FIG. 1, illustrating that the backrest is upright.
Figure 21:
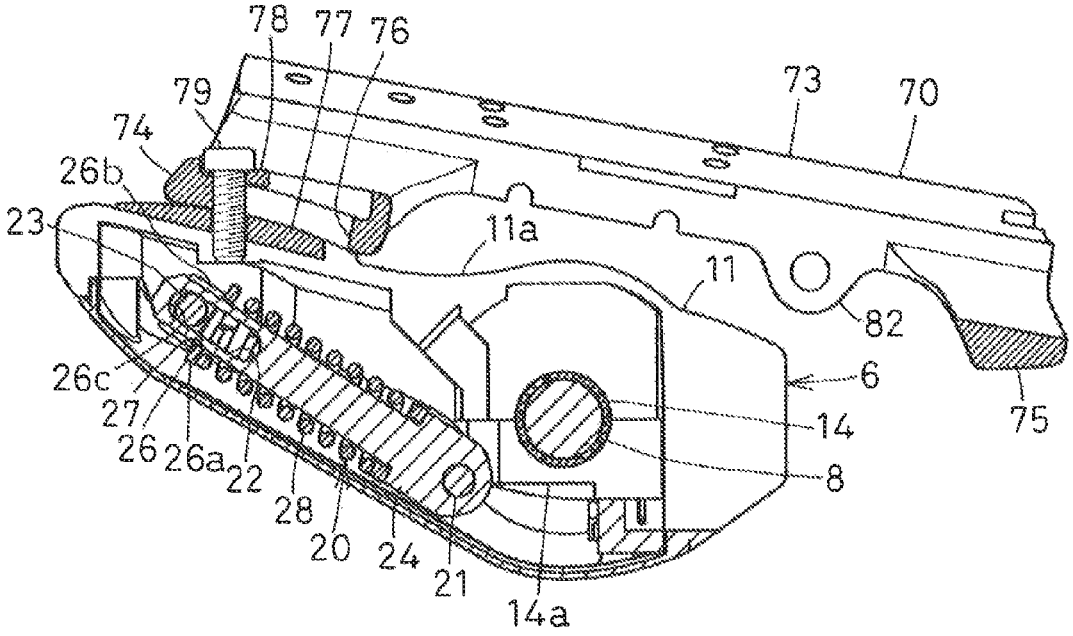
FIG. 21 is a vertical sectional side view similar to FIG. 20, illustrating that a seat moves backward and downward with rearward inclination of the backrest.

In FIGS. 3, 20 and 21, in the front of the upper surface of the base body 11, there is provided a pair of holding plates 77,77 having an arcuate upper surface having a large curvature. On the holding plate 77, the lower surface of the front connecting rod 74 is disposed on the upper surface. A washer 78 in which the back part is thicker than the front part is disposed. A bolt 79 which passes through the washer 78, the elongate hole 76 of the front connecting rod 74 and holding plate 77 is engaged on the upper portion 11*a* of the base body 11. The front part of the seat-holding frame 70 slides over the upper arcuate surface of the holding plate 77 without taking off the upper surface of the base body 11.

A recess 80 formed on the rear end of the holding plate 77 engages with a projection 81 on the upper surface of the base body 11, thereby preventing the holding plate 77 from turning around the bolt 79.

A pair of downward projections 82,82 suspending from the rear lower surface of the right and left guide rods 73,73 of the seat holding frame 70 is connected to upward projections 83,83 with a transverse shaft 84. With backward inclining of the backrest 10, the seat-holding frame 70 is inclined backward and downward while the back part moves backward and downward and the front part slides backward along the arcuate upper surface of the holding plate 77.

Figure 22:
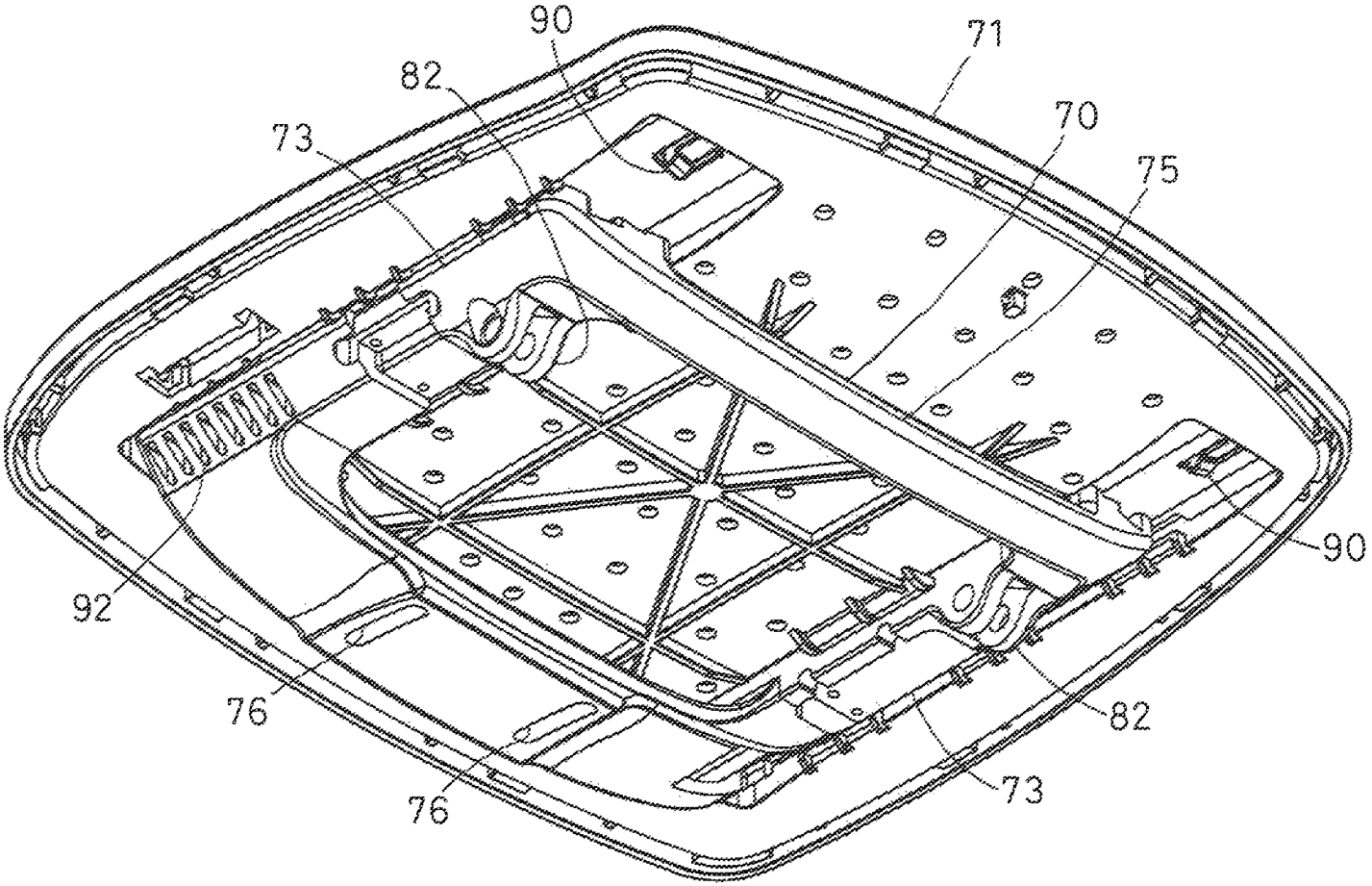
FIG. 22 is a perspective view of a seat-holding frame and a seat plate viewed from below.
Figure 23:
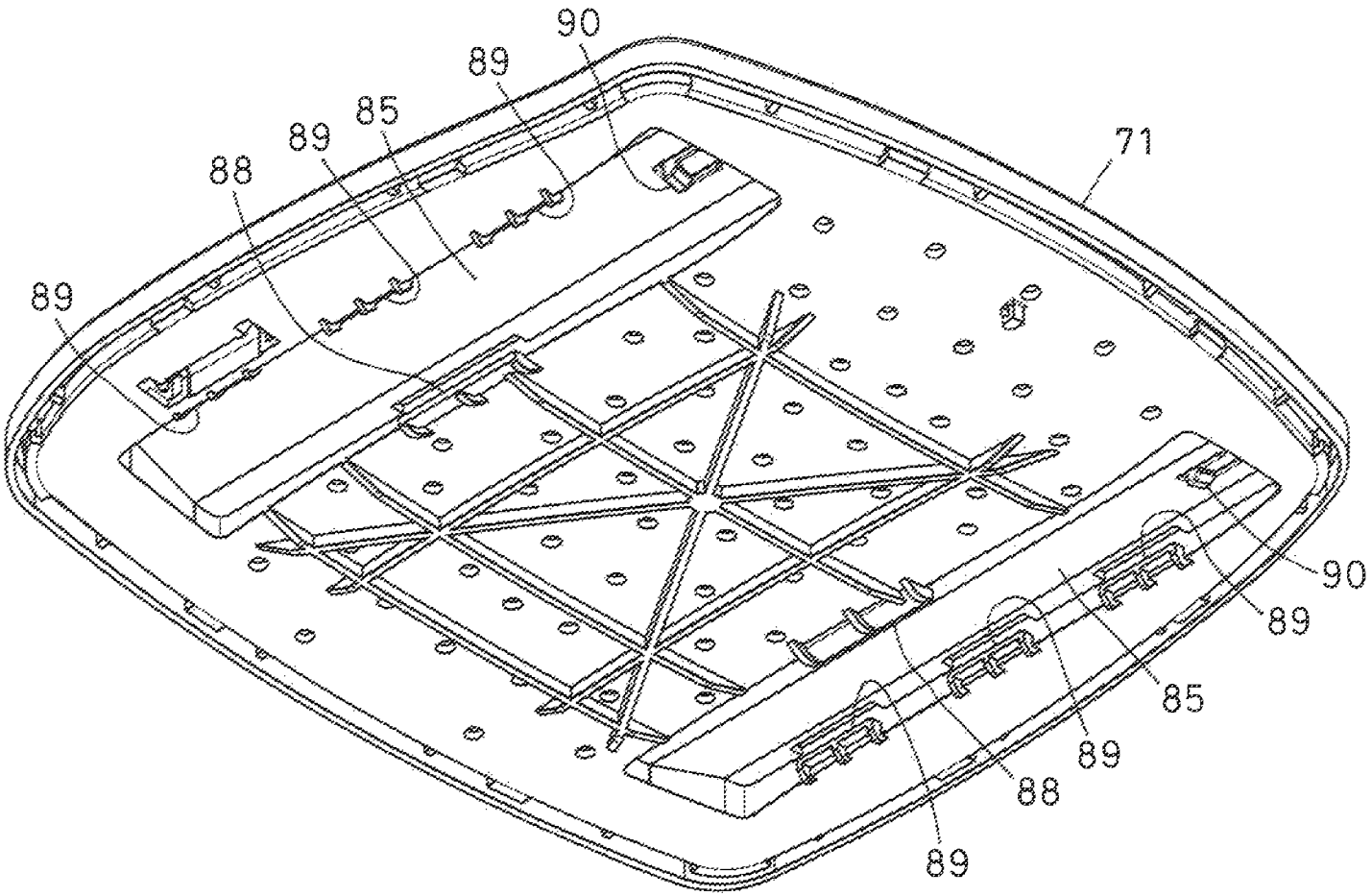
FIG. 23 is a perspective view of the seat plate viewed from below.

In FIG. 22, right and left guide rods 73,73 of the seat-holding frame 70 engage with the right and left sides on the lower surface of the seat plate 71. There is formed a pair of grooves 85,85 such that the seat plate 71 slides along the chair with respect to the guide rods 73,73 within a certain range.

The right and left grooves 85,85 are formed slightly inward of the side ends, and the right and left guide rods are spaced inward from the ends of the seat plate 71.

In FIGS. 23-27, on inner and outer edges of the groove 65, there is provided a plurality of engagement projections 88,89 which engage with a plurality of outward projections 86,87 projecting sideward from the side edge of the guide rod 73 in the groove 85.

In this embodiment, a downward projection and an engagement projection 88 are provided A longer outward projection 86 and a longer engagement projection 88 are provided on the inner edge of the guide rod 73 and the inner edge of the groove 85 respectively. Three shorter outward projections 87 and three shorter engagement projections are provided on the outer edge of the guide rod 73 and the outer edge of the groove 85. When the seat plate 71 is located from a back limit to a borderline just before a front limit, the outward projections 86,87 engage with the engagement projections 88,89, thereby preventing the guide rod 73 from leaving the groove 85 downward. When the seat plate 71 is located closer to the front limit beyond the borderline, all of the outward projections 86,87 do not disengage from the engagement projections 88,89.

The number, length and space of the outward projections 86,87 and engagement projections 88,89 are determined so that the guide rod 73 may not leave the groove 85 with engagement of them within a certain moving range. Compared with a case where the outward projections 86,87 and engagement projections 88,89 are provided over the whole moving range, the areas of mold drawing holes 88*a*,89*a* for forming the engagement projections 88,89 become smaller in FIGS. 23 and 27 thereby preventing the seat plate 71 from decreasing in strength.

On an upper wall of the groove 85 of the seat plate 71, there is provided a downward elastically-engaging portion 90 which comes in contact with the rear end of the guide rod 73 to prevent the seat plate 71 from moving further toward the front limit when the seat plate 71 reaches to the borderline.

The elastically-engaging portion 90 is elastically deformed upward to take off a moving path of the guide rod 73 thereby enabling the seat plate 71 to move toward the front limit. During the time, the seat plate 71 is only raised, so that the seat-holding frame 70 can easily be removed.

In order to attach the seat plate 71 to the seat-holding frame 70, the seat plate 71 is put over the seat-holding frame 70 such that the seat plate 71 is positioned from the borderline to the front limit with respect to the seat holding frame 70, and the elastically-engaging portion 90 is pushed up with the upper surface of the guide rod 73 of the seat-holding frame 70. The seat plate 71 is moved backward while it pushes over the seat-holding frame 70, and each of the guide rods 73 is positioned forward of the borderline in the groove 85.

The guide rod 73 moves forward of the borderline in the groove 85, and the elastically-engaging portion 90 projects into the moving path of the guide rod 73 in the groove 85. Thereafter, the guide rod 73 is not able to move backward of the borderline relatively, and the seat plate 71 does not take off the seat holding frame 70.

Operating means of each part will be described.

Longitudinal position adjusting means for the seat plate 71 to the seat holding frame 70 will be described.

In FIG. 22, a plurality of slits 92 is formed in the front part of the right side surface of the seat holding frame 70.

Figure 24:
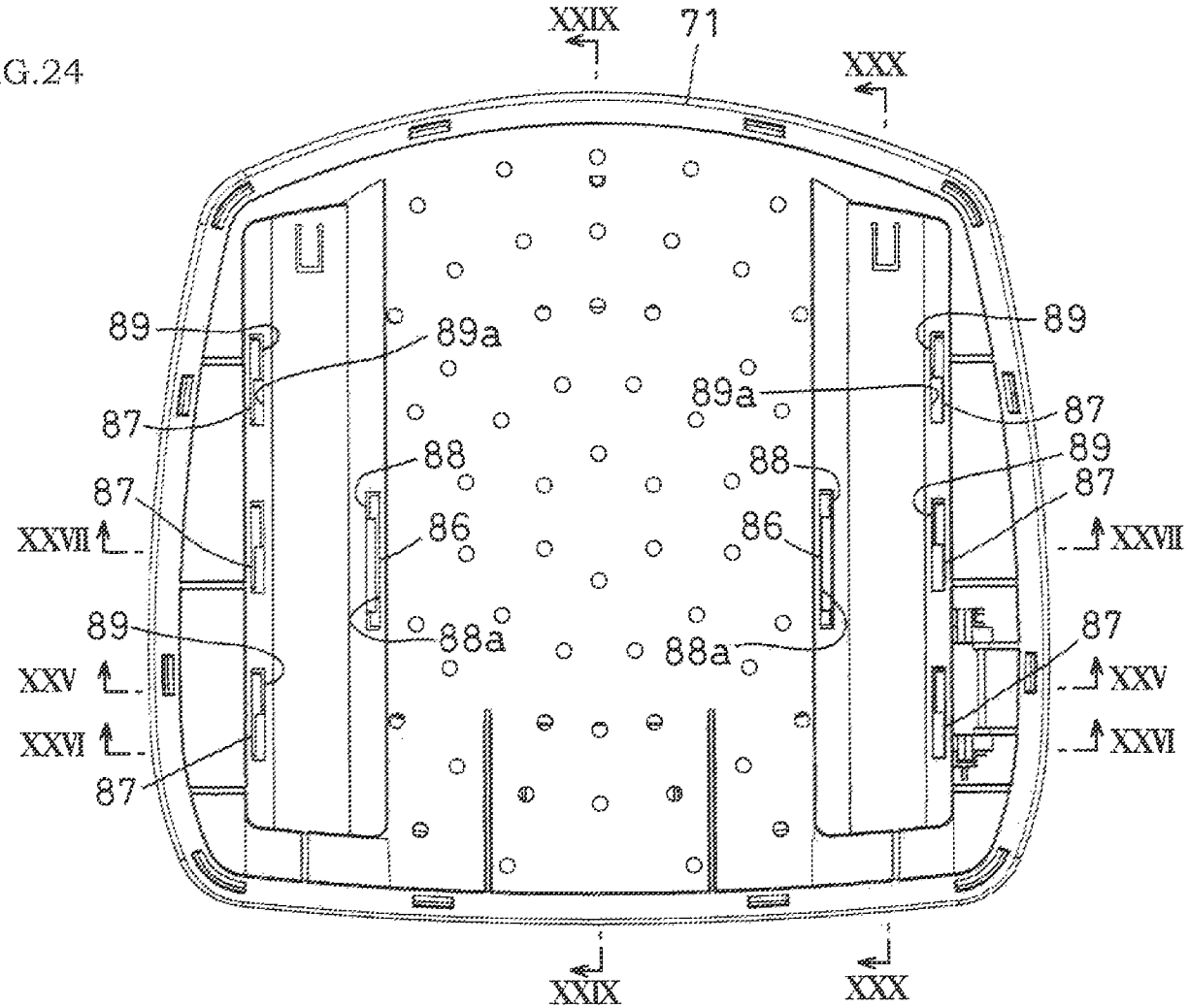
FIG. 24 is a top plan view of the seat plate.
Figure 25:
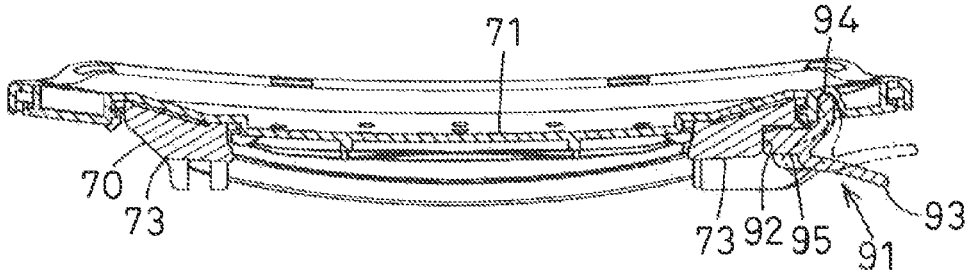
FIG. 25 is a vertical sectional front view taken along the line XXV-XXV in FIG. 24.
Figure 26:
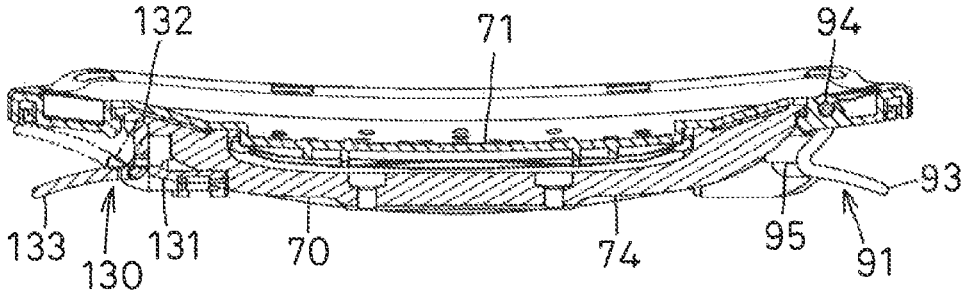
FIG. 26 is a vertical sectional front view taken along the line XXVI-XXVI in FIG. 24.

In FIGS. 24-26, an operating lever 93 projects outward and downward of the lower surface of the seat plate 71. A shaft 94 at the upper end of the operating lever 93 is disposed in the right side of the seat plate 71.

An engagement claw 95 projecting inward of the seat 7 is provided in the operating lever 93. The engagement claw 95 selectively engages with any one of the slits 92 of the seat holding frame 70, so that the seat plate 71 is held at a desired position with respect to the seat holding frame 70.

Biasing means for biasing the operating lever 93 in a direction for engaging the engagement claw 95 with the slit 92, but is not shown.

The slits 92 and the operating lever 93 constitute seat-longitudinal-position adjusting means 91.

Then, locking means 100 for operating the locking device 32 will be described.

Figure 27:
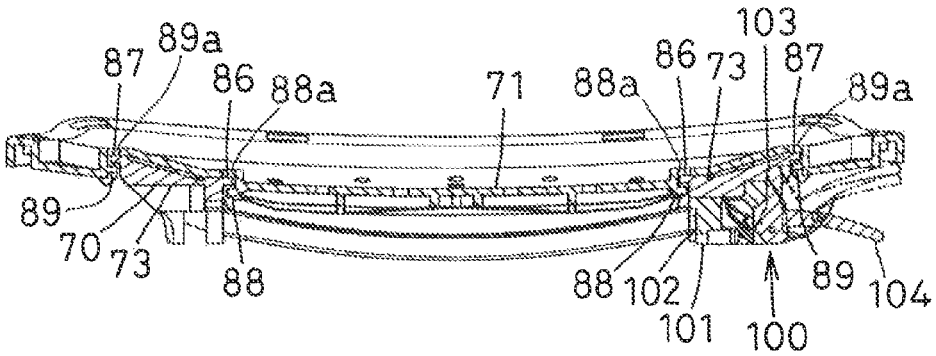
FIG. 27 is a vertical sectional front view taken along the line XXVII-XXVII in FIG. 24.
Figure 28:
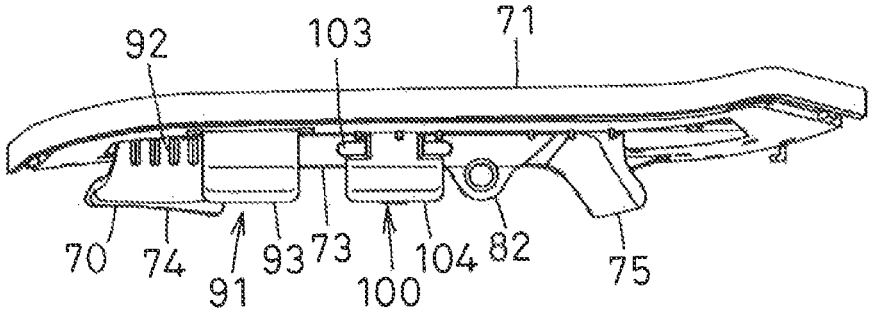
FIG. 28 is a side elevational view of the seat holding frame and seat plate.
Figure 29:
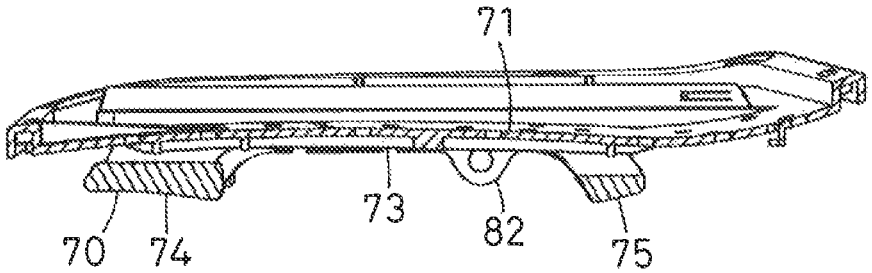
FIG. 29 is a vertical sectional side view taken along the line XXIX-XXIX in FIG. 24.
Figure 30:
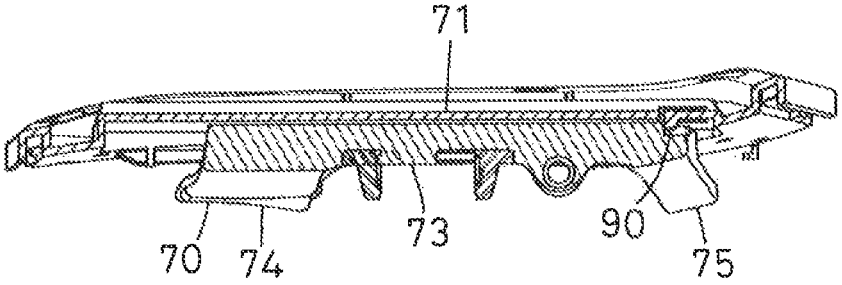
FIG. 30 is a vertical sectional side view taken along the line XXX-XXX in FIG. 24.

In FIGS. 2 and 27, the locking means 100 is disposed at the right end of the seat-holding frame 70 behind the longitudinal-position-adjusting means 91.

In FIG. 27, the locking means 100 comprises a body 101 mounted to the lower surface in the middle of the right guide rod 73 of the seat holding frame 70; and an operating lever 104 pivotally mounted to a case 102 with a shaft 103 and projecting from the lower surface of the seat plate 71 outward and downward.

As mentioned above, the right and left guide rods 73,73 are spaced from each end of the seat plate 71. Thus, the operating lever 104 can be disposed under the side end of the seat plate 104 not to project outward, and the lower surface of the seat plate 71 can be a stopper when the operating lever 104 is pulled up. Furthermore, while gripping the seat plate 71, the operating lever 104 can be operated thereby enhancing operation capability.

The other end of the outer tube 35 of the Bowden cable 34 connected to the locking device 32 is mounted to the case 102 of the body 101.

The end of the inner wire 36 pulled out of the outer tube 35 is mounted to the operating lever 104, which is turned upward from the locking position in FIG. 27, so that the inner wire 36 can be pulled.

In the body 101, there is provided a known device in JP2006-136437A that the operating lever 104 is pulled up from the locking position to an upper operating position drawn by an imaginary line in FIG. 27, held in a lower unlocking position by an imaginary line in returning, pulled up to the operating position again from the position to turn the locking position in returning repeatedly thereafter.

When the operating lever 104 is in the locking position, the locking member 33 can be held in the locking position due to balance of the inner and outer compression springs 37,38. When the operating lever 104 is in the unlocking position, the locking member 33 can be held in the unlocking position due to balance of the inner and outer compression springs 37,38.

Thus, when the operating lever 104 is in the locking position, the backrest 10 can be constricted, and when the operating lever 104 is in the unlocking position, the backrest 10 can be turned freely longitudinally of the chair although a biasing force of the first biasing means 20 and the second biasing means 40 acts.

Operating means for the biasing-force adjusting means 39 will be described with respect to FIGS. 31 to 34.

Figure 31:
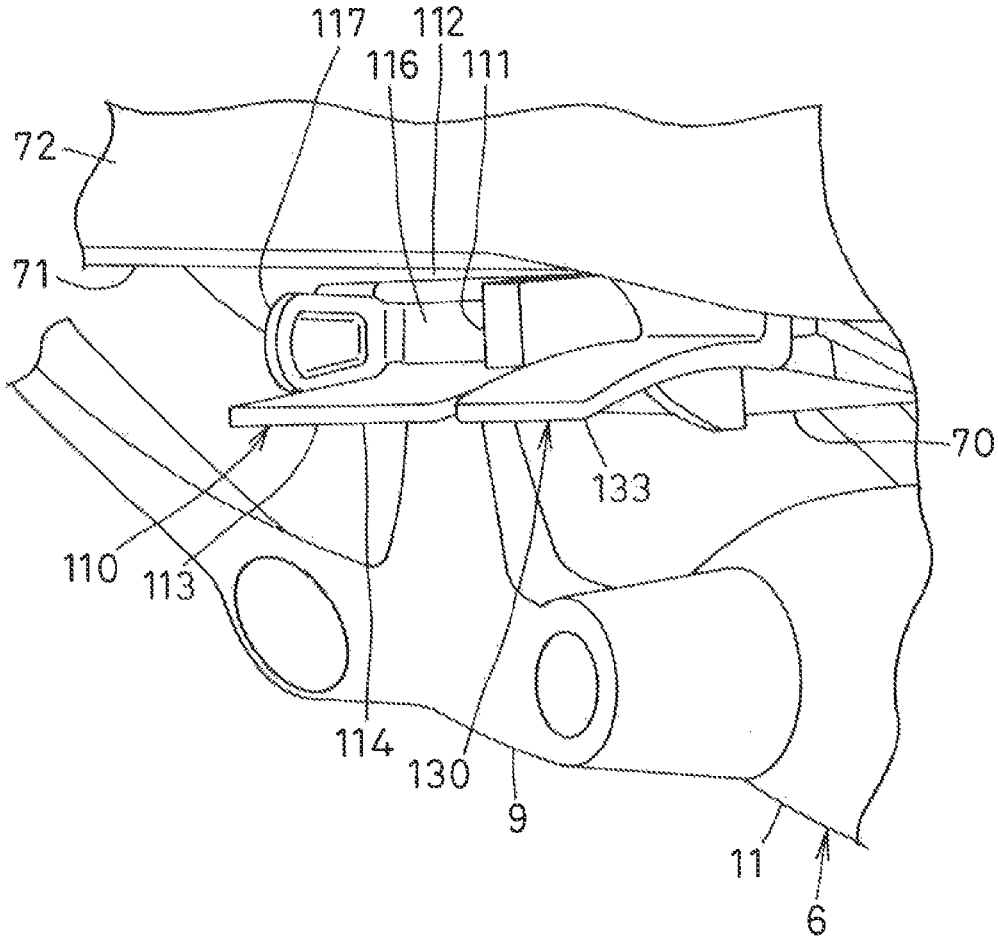
FIG. 31 is a perspective view of a mounting portion of an operating device of biasing-force adjusting means for the backrest viewed from above.

In FIG. 31, the operating means 110 is provided on the lower surface of the seat holding frame 70.

The operating means 110 comprises a body case 112 mounted to the lower surface of the left guide rod 73 of the seat holding frame 70, and having an opening and a window 111; a lower cover 114 which closes the lower opening of the body case 112 and projects outward of the body case 112 to form a lower guard 113; a rotary member 116 which is pivotally mounted via a shaft 115 in the body case 112 and connected to the moving member 50 of the biasing-force adjusting means 39 via the inner wire 57 of the Bowden cable 59 to rotate around the shaft 115 to move the moving member 50; and an operating lever 117 which projects on the outer circumferential surface of the rotary member 116 through the window 111 of the body case 112 and turns within a space between the lower surface of the seat plate 71 and the lower guard 113 of the lower cover 114.

For attachment of the operating means 110, it is useful to space the right and left guide rods 73,73 inward from the ends of the seat plate 71.

The outer end of the lower guard 113 is positioned right or inward under the outer end of the seat plate 71. Thus, the lower guard 113 cannot project outward from the seat plate 71. If the lower guard 113 projects outward from the seat plate 71, the occupant will hand on the upper surface of the lower guard 113 and loads it, so that the lower cover 114 does not fall off. Such accident can be prevented.

Figure 33:
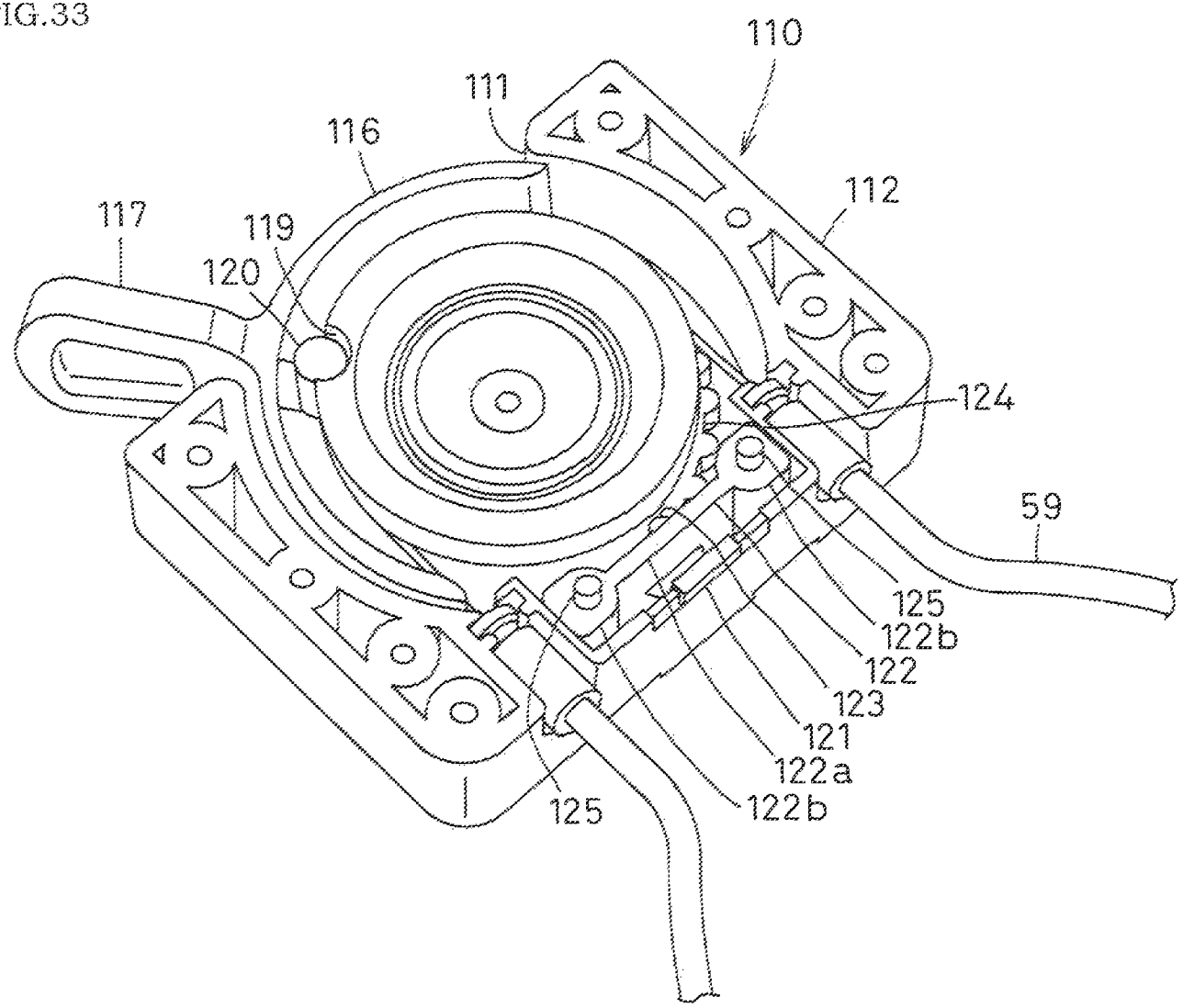
FIG. 33 is a perspective view of the operating device in FIG. 32 from which a lower cover is removed.

In FIG. 33, the other ends of a pair of outer tubes 58,58 of the Bowden cable 59 are mounted to the body case 112 respectively.

Because the operating means 110 is constructed as above, the lower part of the operating lever 117 can be guarded by the lower guard 113 of the lower cover 114 thereby preventing the operating lever 117 from hitting other material. The operating lever 117 becomes unlikely to expose outside thereby enhancing its appearance.

Figure 32:
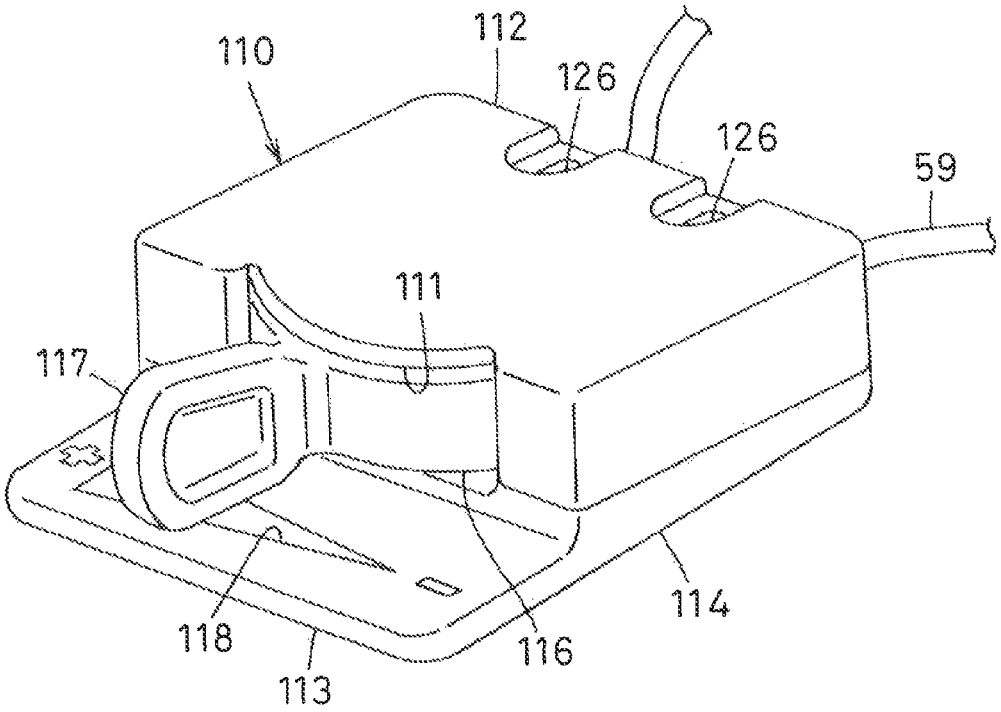
FIG. 32 is a perspective view of the operating device of the biasing-force adjusting means, viewed from above.

On the upper surface of the lower guard 113, the indications on the operating lever 117 such as an isosceles triangle 118 and "+−" in FIG. 32 are applied thereby leading easier understanding on how to operate the operating lever 117.

In FIG. 33, the rotary member 116 is a circular pulley in this embodiment, and a semi-circular notch 119 is formed on the outer circumferential surface. A circular wire stopper 120 fixed to the inner wire 57 wound on the outer circumferential surface of the rotary member 116 engages in the notch 119, so that part of the inner wire 57 is mounted to the part of the outer circumferential surface of the rotary member 116.

The rotary member 116 can be made to be semi-arcuate or sector-shaped depending on a turning range or may be a cross having a perpendicular arm to the operating lever 117, two inner wires being mounted to the end of the arm.

By taking the lower cover 114 off the structure, the Bowden cable 59 as connecting means can easily be mounted and removed thereby facilitating assembling and replacement of the connecting means.

In the body case 112, there is provided a pressing member 122 biased toward the outer circumferential surface of the rotary member 116 with a leaf spring 121. A semi-arcuate projection 123 is provided in the middle of the pressing member 122 facing the rotary member 116. On the outer circumferential surface of the rotary member 116 facing it, a plurality of recesses 124 is formed to elastically engage with the projection 123 at a different rotary position of the rotary member 116, thereby applying moderation to the rotating operation of the operating lever 117 and enhancing operation capability.

The pressing member 122 has wider portions 122*b*,122*b* at each end of a base portion 122*a*. The end faces are guided to slide on guide surfaces 112*a*,112*a* facing each other in the body case 112. The upper and lower ends of guide shafts 125,125 passing through the wider portions 122*b*,122*b* slides in a pair of elongate holes 126,126 of the body case 112 and in a pair of grooves (not shown) in the upper surface of the lower cover 114 smoothly.

Figure 34:
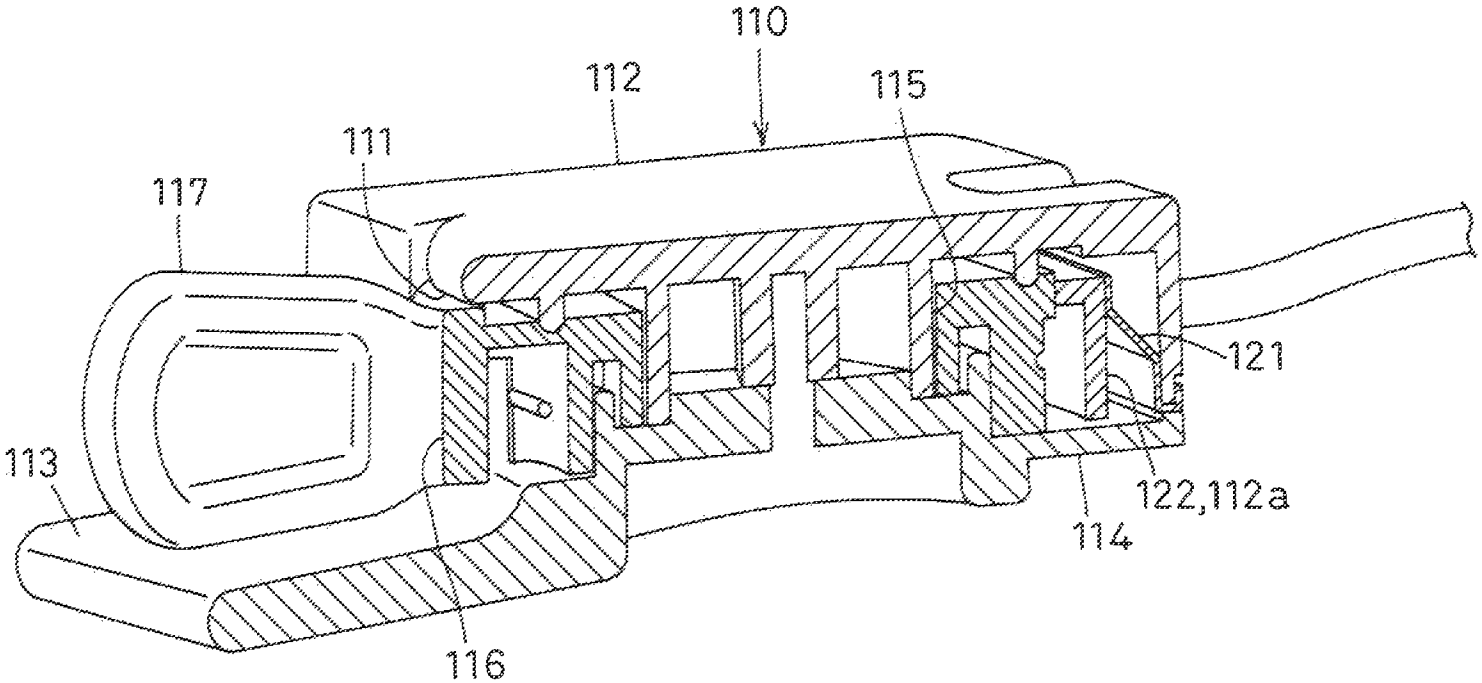
FIG. 34 is a perspective view of the operating device in FIG. 32 cut vertically and viewed from above.
Figure 35:
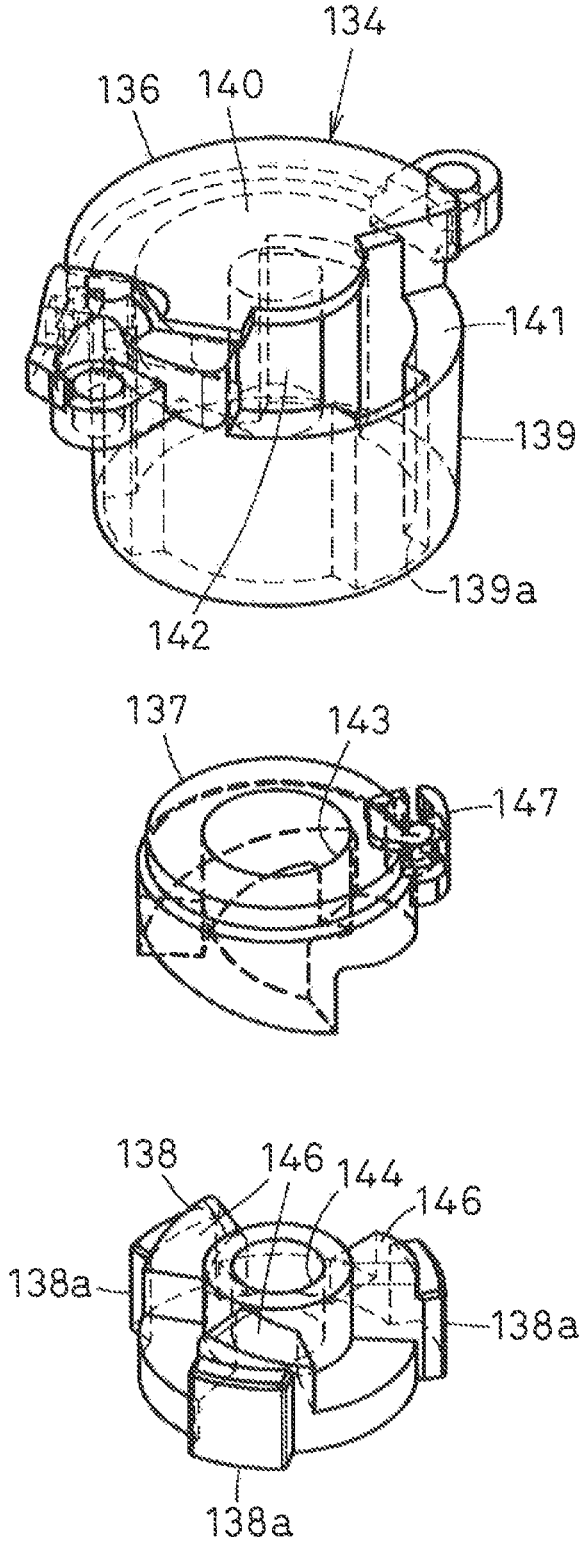
FIG. 35 is an exploded perspective view of a height adjusting device of the seat.
Figure 36:
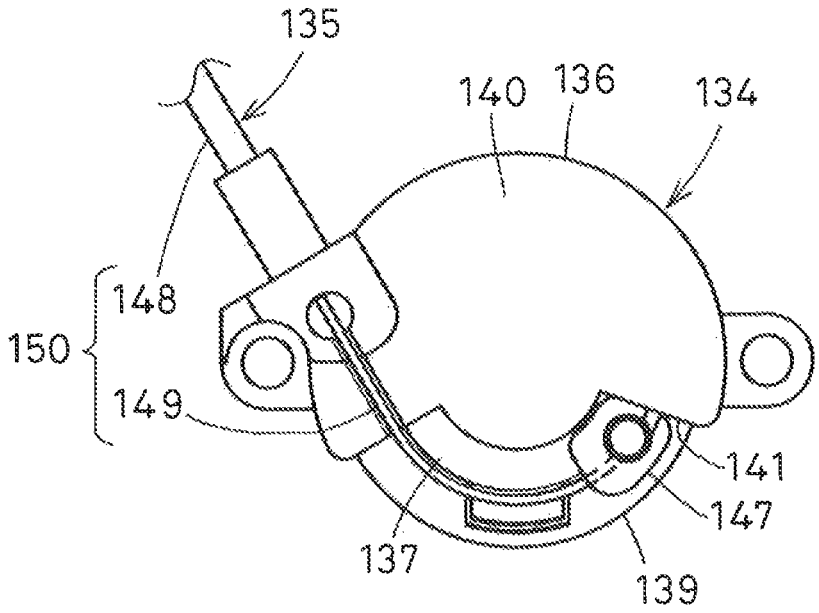
FIG. 36 is a top plan view thereof.

In FIG. 34, the leaf spring 121 has a U-shaped lower end which engages with an open edge at the lower end of the body case 114 on the lower cover 114. The lower cover 114 is screwed to the body case 112 and fixed without special fixing means.

Therefore, fixing means for the leaf spring is not required thereby simplifying the structure and manufacturing them at low cost.

The leaf spring 121 is inclined at an upper part toward the rotary member 116 and comes in contact with the pressing member 122 at the upper end thereby biasing the pressing member 122 toward the rotary member 116.

Then, height adjusting means for the seat will be described.

In FIGS. 3, 26 and 31, the height adjusting means 130 is pivotally mounted to a holding member 131 mounted over the left side surface to the lower surface with a shaft 132, and comprises an operating lever 133 projecting outward and downward below the seat 133; an end face cam mechanism 134 on the upper surface at the rear part of the base body 11 over the column 5; and connecting means for connecting the operating lever 133 to the end-face cam mechanism 134.

A mentioned above, the right and left guide rods 7373 are spaced inward of each end of the seat plate 71. Hence, the operating lever 133 is disposed below the seat plate 71 not to project outward from the side end of the seat plate 71. The lower surface of the seat plate 71 acts as a stopper for the operating lever 133 which is pulled up. The operating lever 133 can be operated with a hand over the seat plate 71 thereby enhancing operation capability.

In FIGS. 14, 15 and 35-40, the end face cam mechanism 134 comprises a cylindrical case 136 on the upper surface at the rear part of the base body 11; a rotary member 137 rotatably disposed in the upper part of the case 136; and an elevating member 138 disposed in the lower part of the case 136.

The upper end of a cylindrical portion 139 of the case 136 is closed with an upper plate 140. A sector-shaped notch 141 is formed in the upper plate 139 and cylindrical portion 139.

A downward shaft 142 projects in the middle of the lower surface of the upper plate 140. The shaft 142 is a stepped shaft which comprises an upper larger-diameter shaft 142*a* and a lower smaller-diameter shaft 142*b*.

The larger-diameter shaft 142*a* engages in a larger-diameter hole 143 in the middle of the rotary member 137, and the smaller-diameter shaft 142*b* engages in a smaller-diameter hole 144 in the middle of the elevating member 138.

On the inner surface of the cylindrical portion 139, three vertical grooves 139*a* are equally spaced circumferentially. Three projections 138*a* equally spaced on the outer circumferential surface of the elevating member 138 fit in the vertical grooves 139*a* respectively to slide vertically. The elevating member 138 is able to slide vertically but cannot rotate with respect to the case 136.

On the end face of the rotary member 137, there are provided three tilted cam planes 145 tilted circumferentially. On the end face of the elevating member 138, there are provided three tilted cam planes 146 tilted circumferentially at the same angle as that of the tilted cam planes 145.

In FIGS. 14 and 15, the lower surface of the elevating member 138 is in contact with the upper end of an unlocking pin 4*a* which projects from the upper end of the gas spring 4 at the upper part of the telescopic column 5 and is usually biased upward by biasing means (not shown) for returning the unlocking pin 4*a* in the gas spring 4.

On the upper outer circumferential surface of the rotary member 137, a wire-engaging portion 147 is positioned in the notch 141.

The connecting means 135 comprises a Bowden cable 150 comprising a flexible outer tube 148 which is attached at one end to the holding member 131 in FIGS. 3 and 26 and at the other end to the upper outer circumferential portion of the case 136; and an inner wire 149 which is disposed in the outer tube 148. One end of the inner wire 149 pulled out of one end of the outer tube 149 is attached to the operating lever 133, and the other end of the inner wire 149 pulled out of the other end of the outer tube 148 is wound on the outer circumferential surface of the rotary member 137 and attached to a wire-attaching portion 147.

Figure 37:
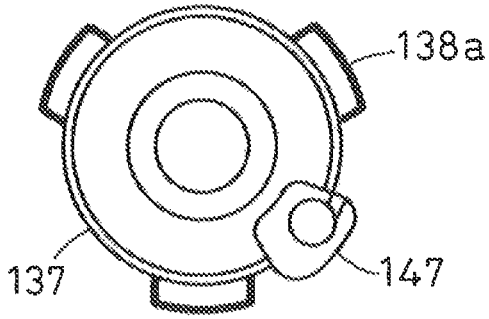
FIG. 37 is a top plan view illustrating an initial position of a tilted cam in the height-adjusting device of the seat.
Figure 38:
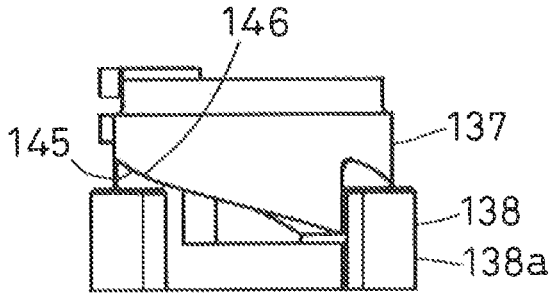
FIG. 38 is a front elevational view illustrating an actuating position of the tilted cam.
Figure 39:
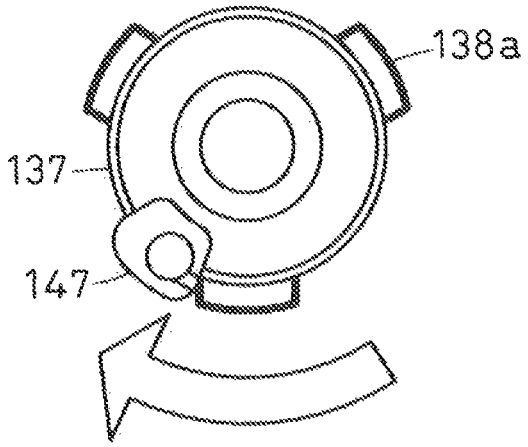
FIG. 39 is a front elevational view illustrating relationship between the tilted cam and an elevating object when the tilted cam of the height-adjusting device of the seat is in an initial position.
Figure 40:
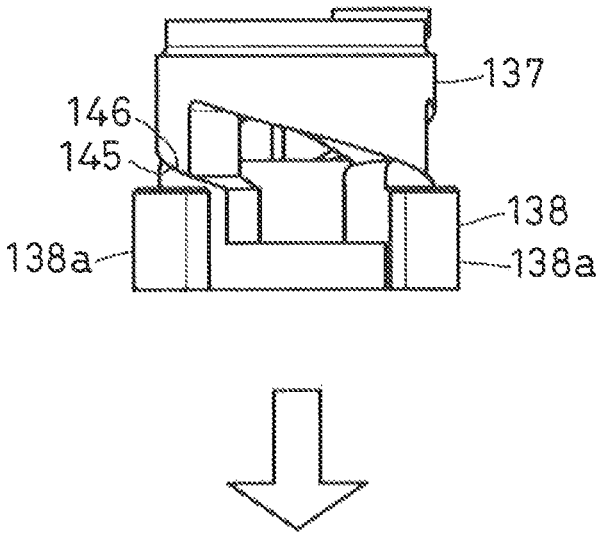
FIG. 40 is a front elevational view illustrating relationship between the tilted cam and the elevating object when the tilted cam is in an actuating position.
Figure 41:
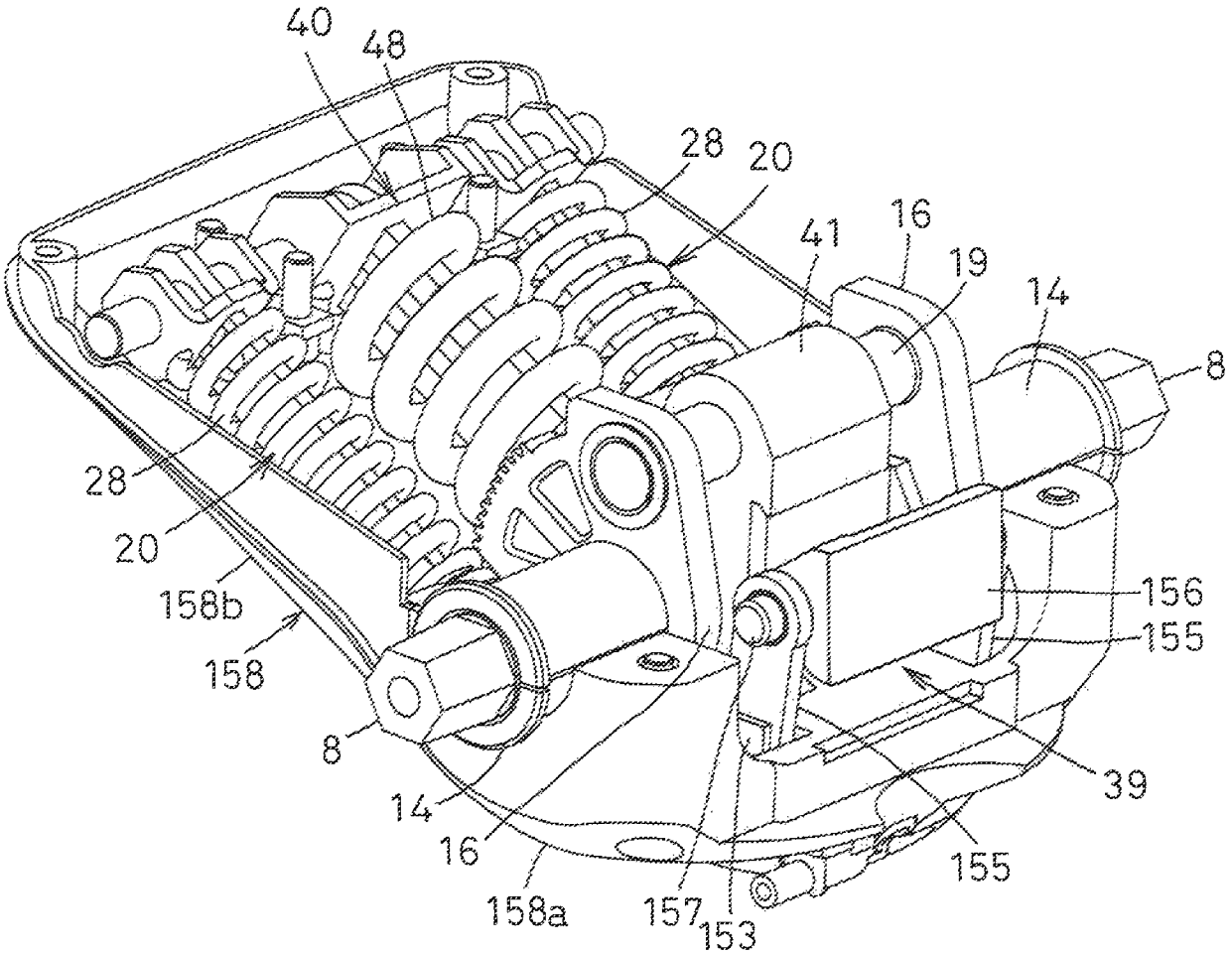
FIG. 41 is a perspective view of a base without a base body in a chair in a variation, viewed from above.

In the height-adjusting means 130, the operating lever 133 is pulled up from a non-actuating position in a solid line to an actuating position in an imaginary line in FIG. 26 to make the inner wire 149 pulled, and the rotary member 137 rotates from a position in FIG. 37 to a position in FIG. 39. The tilted cam plane 145 of the rotary member 137 slides on the tilted cam plane 146 of the elevating member 138, and the elevating member 138 is pressed down. The unlocking pin 4*a* of the gas spring 4 is pressed down thereby enabling the column to retract freely.

When the seat 7 reaches a desired height, a hand gets away from the operating lever 133. A returning force of the unlocking pin 4*a* of the gas spring 4 presses up the elevating member 138. With sliding motion of the tilted cam plane 146 of the elevating member 138 with the tilted cam plane 145 of the rotary member 137, the rotary member 137 rotates reversely to the above, the inner wire 149 is pulled toward the end face cam mechanism 134, and the operating lever 133 returns to the non-actuating position.

FIGS. 41-52 illustrate a main part of a chair comprising a variation of the biasing-force adjusting means 39. The same numerals are allotted to the same members as those in the foregoing embodiments, and detailed description thereof is omitted.

A fulcrum member 151 in this embodiment is a roller and a moving mechanism 152 for moving the fulcrum member 151 vertically comprises a U-shaped horizontally-moving member 153; and a pair of link arms 155,155 pivotally mounted to right and left upright portions 153*a*,153*a* of the horizontally-moving member 153 via right and left support shafts 154,154. The distance between the right and left upright portions 153*a* and 153*a* is wider than the biasing-force transmitting member 41. When the horizontally-moving member 153 moves forward, it does not come in contact with the rear end of second biasing means 20 and the lower end of the biasing-force transmitting member 41. In order that the support shafts 154 also act as a guide shaft for guiding the moving mechanism 152 longitudinally of the chair, they project from the outer side surface of the link arm 155.

The fulcrum member 151 is pivotally mounted via a pivot shaft 157 which runs through the link arms 155 and fulcrum member 151 between forward portions 156*a* and 156*a* of a U-shaped support member 156 disposed between facing surfaces of the upper ends of the right and left link arms 155. The front faces of the support member 151 are in sliding contact with the rear surface in the middle of the biasing-force transmitting member 41.

The horizontally-moving member 153 is supported on the upper surface of a support plate 159 fixed to the upper surface of a rear lower cover 158*a* of the base 6 so as to move the rear lower part of the second biasing means 40. The lower cover 158 in this embodiment comprises the rear lower cover 158*a* and a front lower cover 158*b* in FIG. 43.

In front of the support shaft 154 of the link arm 155, to the right and left upright portions 153*a*,153*a* of the horizontally-moving member 153, guide shafts 160,160 which project outward are fixed such that the upper end thereof is as high as the upper end of the support shaft 154.

On the upper surface of a recessed step 158*e* at the sides of the rear lower cover 158*a*, a pair of L-shaped guide members 161,161 which comprises a horizontal portion 161*a* and a vertical portion 161*b* are mounted with flat screws 162,162 engaged in female thread holes 163,163 of the right and left recessed steps 158*e*. An elongate guide hole 164 is formed in an upright portion 161*b* of the guide member 161.

The right and left support shafts 154,154 of the right and left link arms 155 and right and left guide shafts 160,160 of the horizontally-moving member 153 fit in the elongate guide holes 164,164 of the right and left guide members 161 to move along the chair. The upper ends of the support shaft 154 and guide shaft 160 are in sliding contact with the upper ends of the elongate guide holes 164. Thus, the horizontally-moving member 153 to which the link arms 155 are pivotally mounted can move along the upper surface of the support plate 159 stably.

The lower ends of the horizontally-moving member 153 and the right and left link arms 155 moves along the chair, and the link arms 11 is tilted. The fulcrum member 151 and the support member 156 moves vertically between the biasing-force transmitting member 41 and the vertical wall 11*e* of the base body 11 in FIGS. 43 and 44. On the vertical wall 11*e* of the base body 11, a U-shaped guide plate 165 is mounted to prevent wear thereon and to vertically guide the support member 156 stably.

Between the lower surface of the horizontally-moving member 153 and the upper surface in the middle of the rear lower cover 158*a*, there is provided a position changing device 166 for moving a moving mechanism 152 and stopping it at a certain position.

In FIG. 42 and FIGS. 47-52 (without the fulcrum member 151 and support member 156), the position changing device 166 comprises a rack-like stopper member 168 having a plurality of serrated engagement grooves 167; an actuating member 170 slightly shorter than the stopper member 168 and having an obtuse V-shaped recess 169 formed by a pair of tilted planes 169*a*,169*a* in the middle; a locking member 173 having a plurality of engagement projections 171 engagable with the engagement grooves 167 of the stopper member 168 and a projection 172 which engages in the recess 169; and a moving member 175 having a recess 174 which houses the locking member 173 to move with the locking member 173.

The stopper member 168 is disposed on the upper surface of a bent portion 176*a* at a left side of a base plate 176. By engaging a bolt (not shown) inserted from below of the base plate 176 in a female thread hole 177 of the stopper member 168, the stopper member 168 is fixed to slightly project sideward from the inner edge of the bent portion 176*a*.

An upward portion 176*b* is provided at the left side edge of the bent portion 176*a* of the base plate 176. Upward projections 179,179 are formed at the upper end of the upward portion 176*b* to engage engagement holes 178,178 at a left part of the support plate 159. A bent portion 176*c* which is higher than the left bent portion 176*a* is formed at a right part of the base plate 176. On the upper surface of the bent portion 176*c*, the right part of the support plate 158 is disposed, and the support plate 159 is disposed on the upper surface of the base plate 176 by engaging the upward projection 179 of the base plate 176 into the engagement hole 178 of the support plate 159 from below in FIG. 45.

Figure 42:
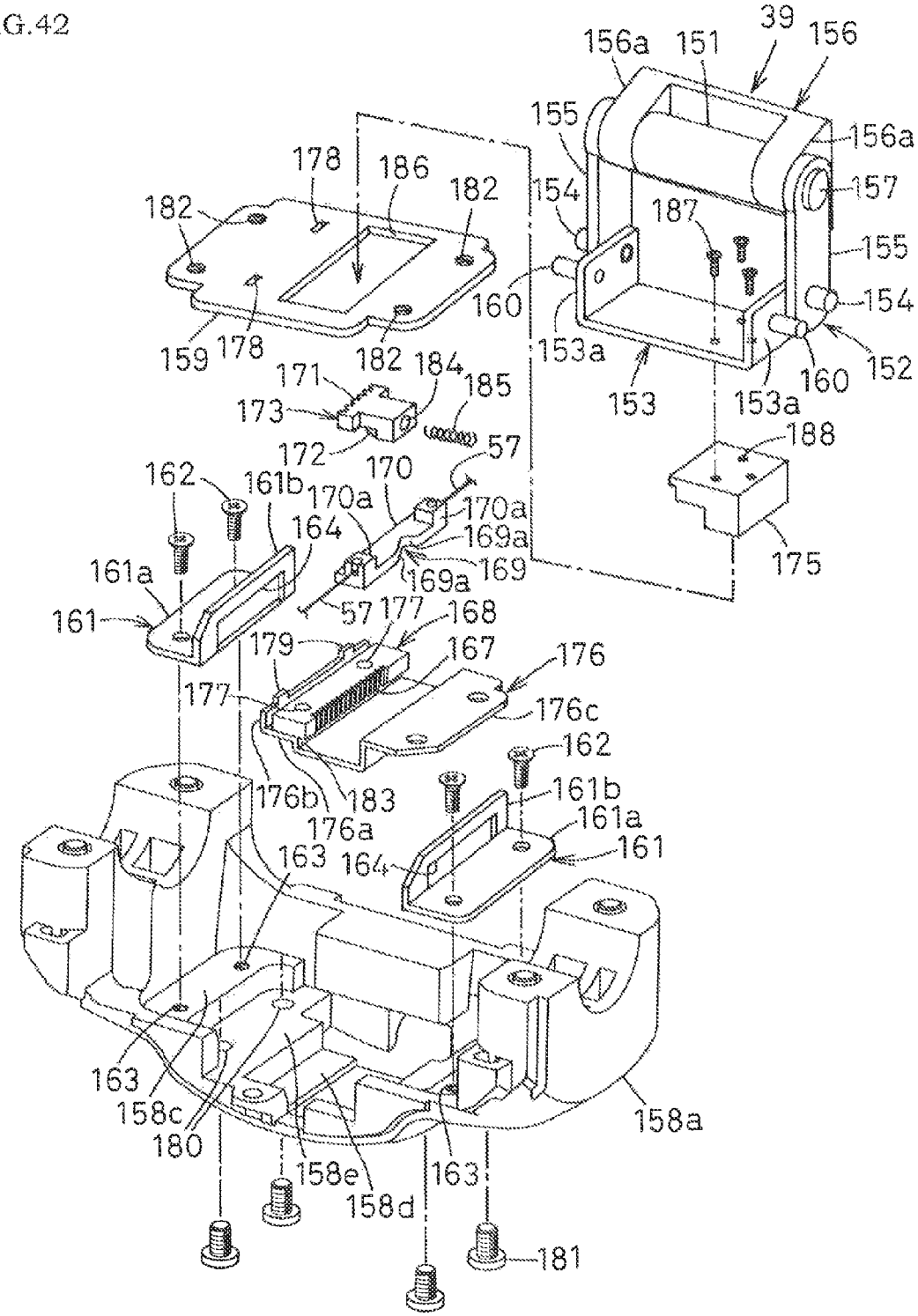
FIG. 42 is an exploded perspective view of biasing-force adjusting means and a position changing device in the variation.

In FIG. 42, in the disposed state, the base plate 176 is housed in a recess 158*d* in the middle of the rear lower cover 158*a*. The lower surface of the right bent portion 176*c* of the base plate 176 and the lower surface of the support plate 159 are disposed on the right and left recessed step 158*e* of the rear lower cover 158*a*. Four bolts 181 inserted into through holes 180 of the right and left steps 158*e* from below of the rear lower cover 158*a* engage in four female thread holes 182 of the support plate 159, so that the support plate 159 and base plate 176 are fixed on the upper surface of the rear lower cover 158*a*.

The actuating member 170 as above is lower than the stopper member 168 at the left side end, and engages in a gap 183 between the upper surface of the base plate 176 and the lower surface of the stopper member 168. The actuating member 170 is supported on the upper surface of the base plate 176 to move in parallel with a direction of moving of the horizontally-moving portion 153 and the moving member 175 in FIG. 48.

Upward projections 170*a*,170*a* are provided on the front and rear ends of the actuating member 170 except the part engaging in the gap 183, and to the projections 170*a*,170*a*, the ends of the inner wires 57,57 of the Bowden cable 59 connected to the operating means 110 are attached. Hence, the actuating member 170 is moved longitudinally of the chair in parallel with a moving direction of the moving member 175.

Figure 48:
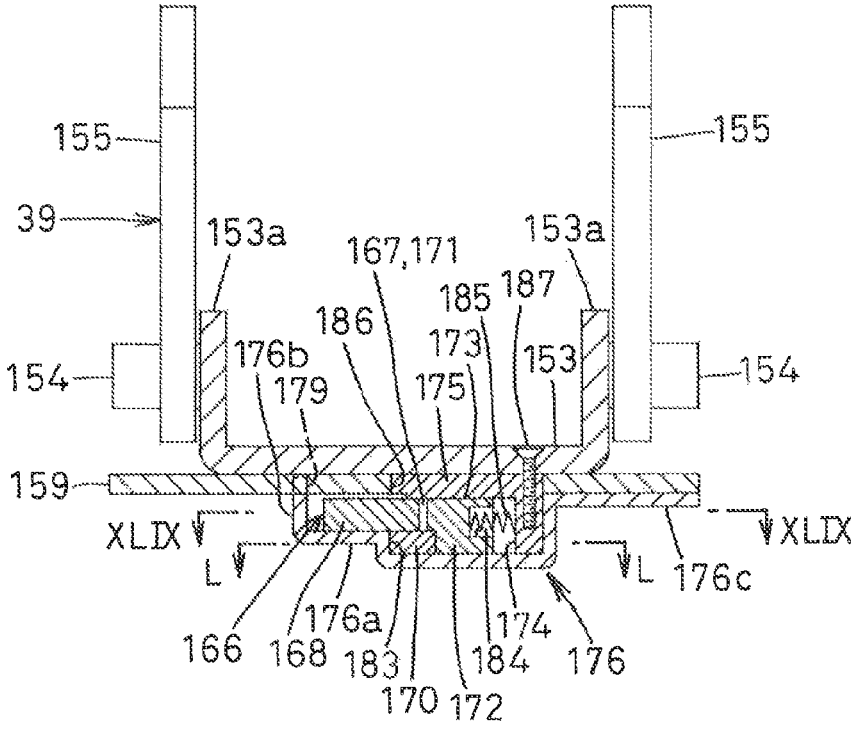
FIG. 48 is a vertical sectional front view taken along the line XLVIII-XLVIII in FIG. 47.

In FIG. 48, the locking member 173 is disposed on the upper surface in the middle of the base plate 176 by the actuating member 170 so as to be approximately coplanar with the upper surface of the stopper member 168. The engagement projections 171 of the locking member 173 are slightly longer than the other parts. The whole locking member 173 can move transversely of the chair perpendicular to the engagement groove 167 of the stopper member 168 in the recess 174 of the moving member 175 and is housed, limiting the maximum rightward moving amount.

Figure 49:
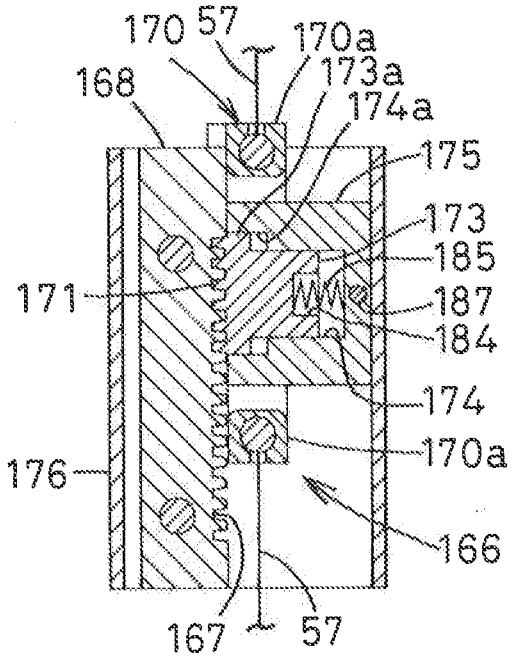
FIG. 49 is a horizontal sectional plan view taken along the line XLIX-XLIX in FIG. 48.

In FIGS. 48 and 49, a compression spring 185 is housed in a blind hole 184 of the locking member 173. The right end of the compression spring 185 is pressed onto the inner surface of the recess 174 of the moving member 175. Thus, the locking member 173 is pressed toward the stopper member 168 and actuating member 170 anytime. The engagement projections 171 of the locking member 173 engage in the engagement grooves 167 of the stopper member 168 anytime.

A wider portion 173*a* of the locking member 173 slides in a wider recess 174*a* of the recess 174. When the locking member 173 moves rightward against the compression spring 185 until the right end of the wider portion 173*a* comes in contact with the left end of the wider recess 174*a*, the engagement projections 171 of the locking member 173 leave the engagement grooves 167 of the stopper member 168 in FIG. 52.

Figure 46:
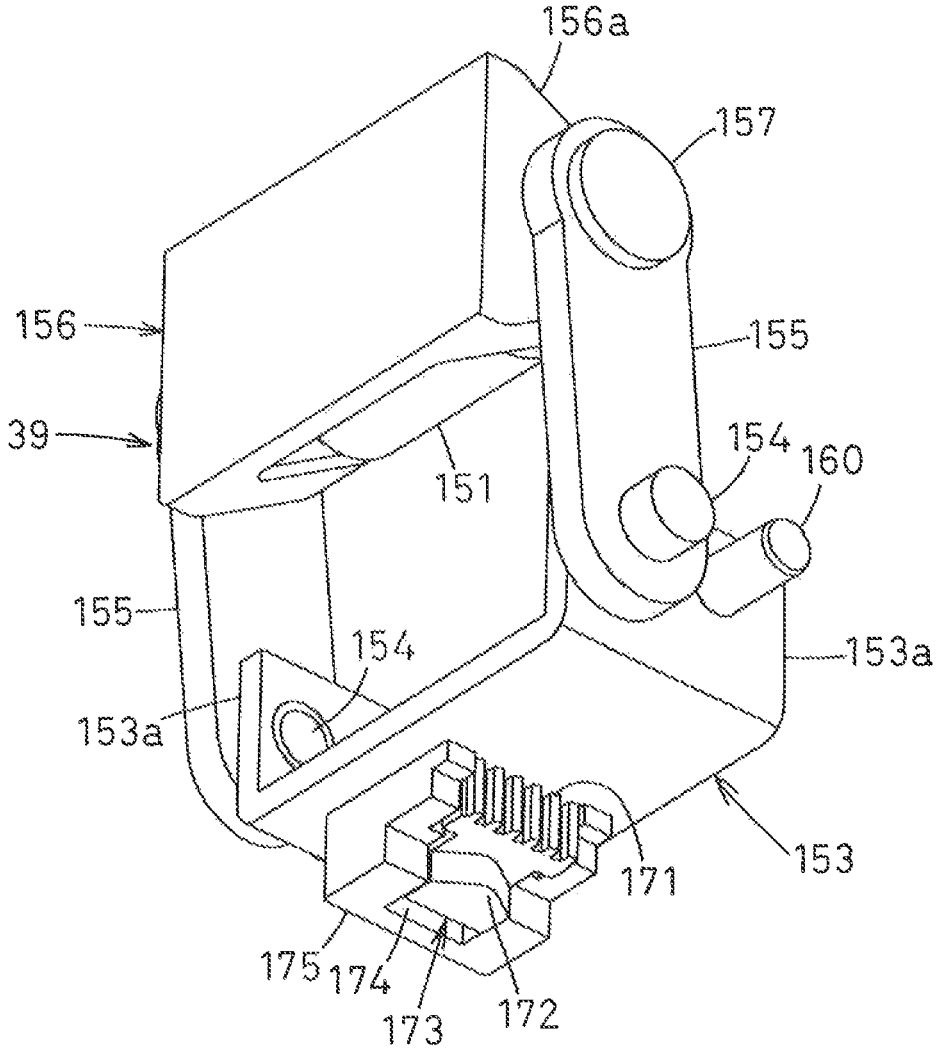
FIG. 46 is a perspective view of part of the biasing-force adjusting means and the position-changing device thereof.
Figure 47:
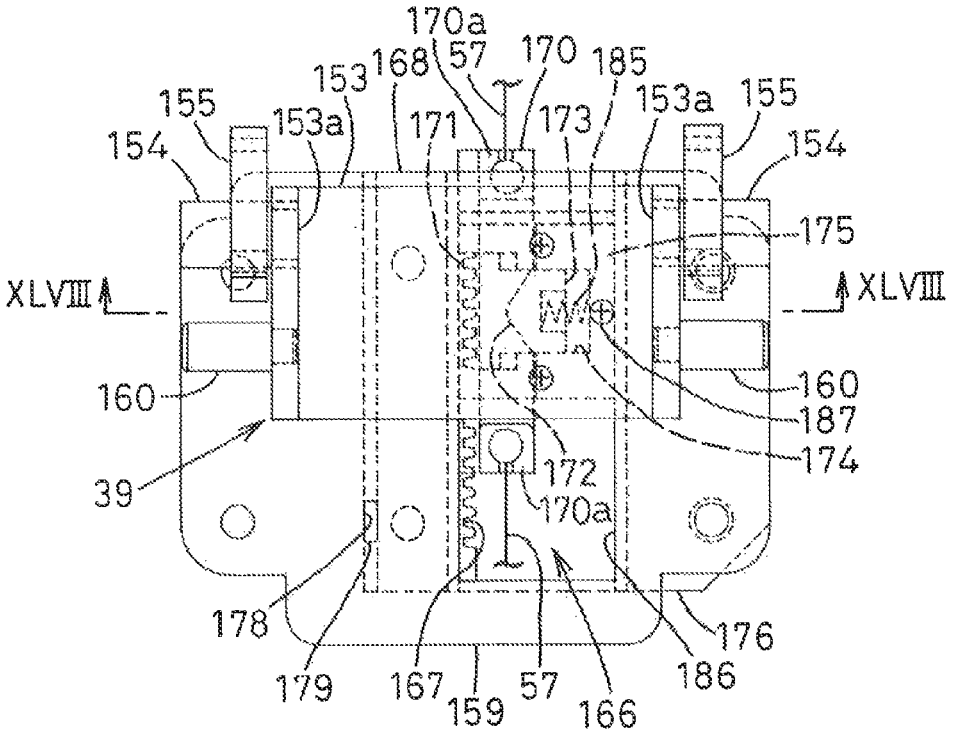
FIG. 47 is a top plan view of the biasing-force adjusting means and the position changing device.

In FIG. 46, the projection 172 of the locking member 173 is shorter than the engagement projection 171 and is formed with the locking member 173 such that the end projects from the recess 174 of the moving member 175. When the engagement projections 171 engage with the engagement grooves 167 of the stopper member 173, the position of the projection 172 is determined to also engage with the recess 169 of the actuating member 170 below the engagement projections 171 of the locking member 173 in FIG. 50. The end of the projection 172 is determined to fit with the recess 169 of the actuating member 170.

In FIGS. 42 and 49, the upper end of the moving member 175 slides in the elongate guide hole 186 of the support plate 159. In this state, the flat screws 187 are engaged in the female thread holes 188 of the moving member 175 and the moving member 175 is fixed to the lower surface of the right part of the horizontally-moving member 153. The lower surface of the right part of the moving member 175 are in sliding contact with the upper surface of the base plate 176 and the inner side surface of the bent portion 176*c*. Hence, the moving member 175 can move with the horizontally-moving member 153 longitudinally of the chair along the elongate guide hole 186 of the support plate 159 and the base plate.

With FIGS. 43, 44 and 49-52, the biasing-force adjusting means 38 and position changing device 166 in the variation will be described on their functions.

Figure 43:
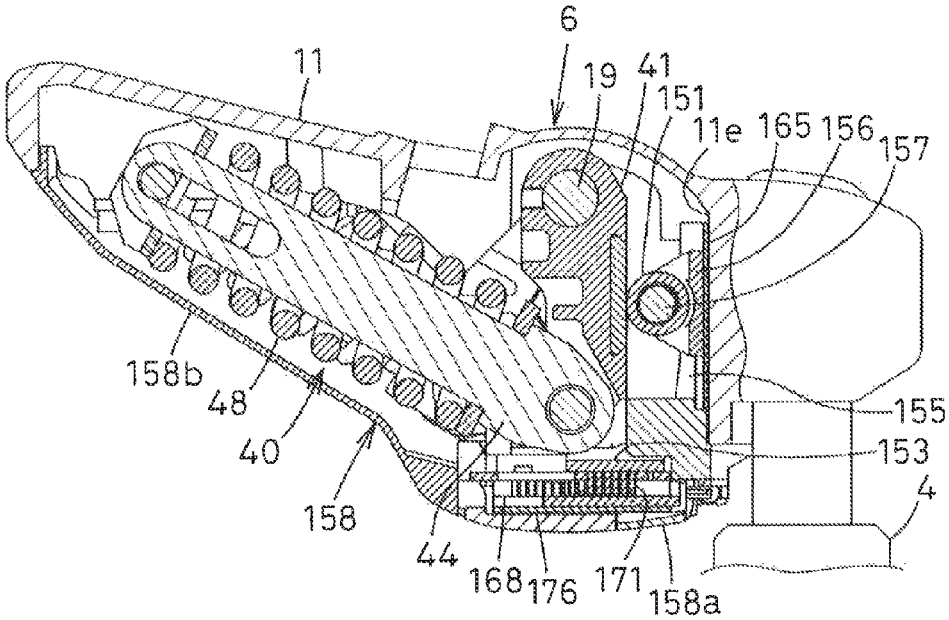
FIG. 43 is a central vertical sectional side view of the base in the variation.
Figure 44:
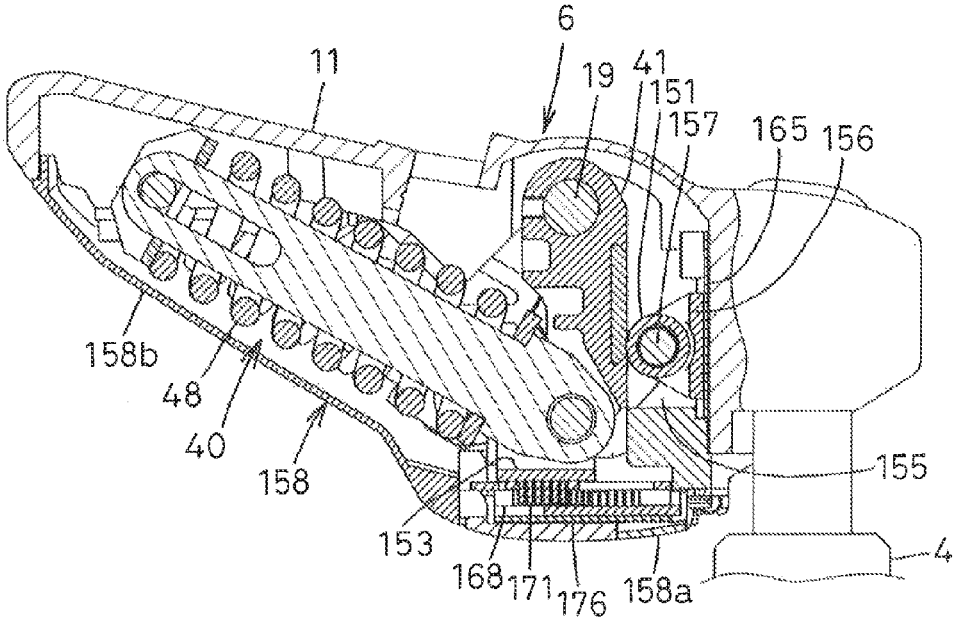
FIG. 44 is a central vertical sectional side view when a fulcrum member moves down in the base in the variation.
Figure 45:
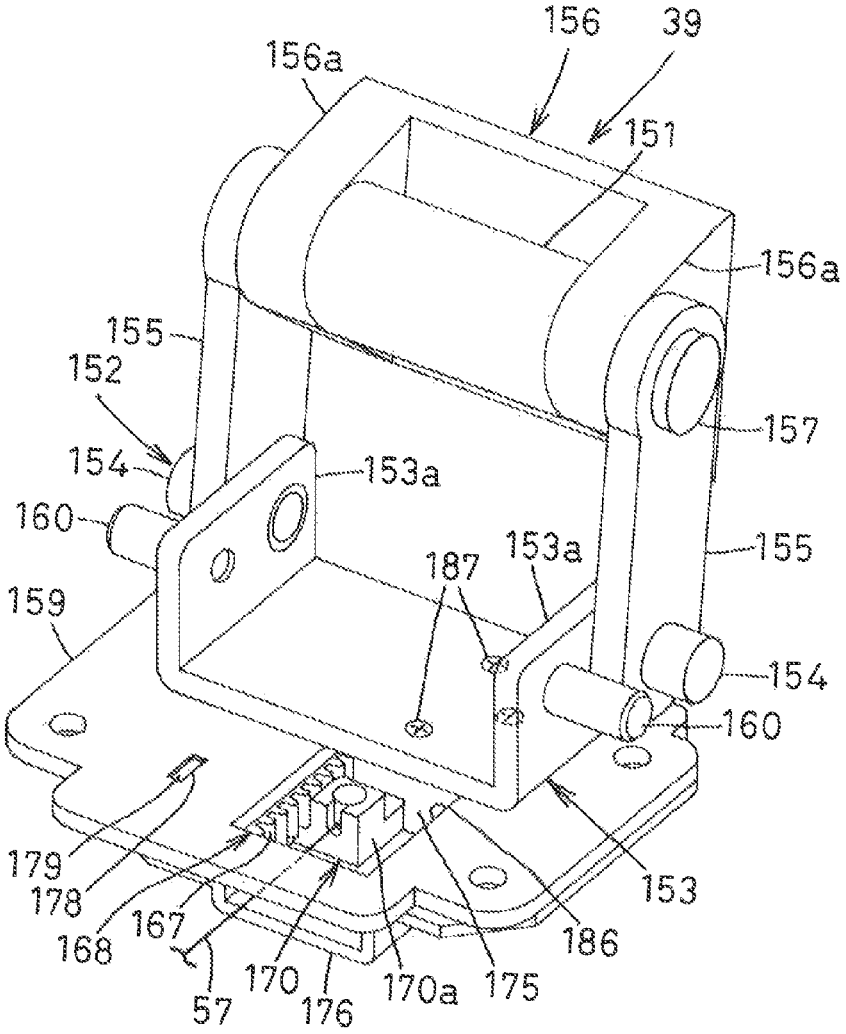
FIG. 45 is a perspective view of biasing-force adjusting means and a position-changing device in the variation.
Figure 50:
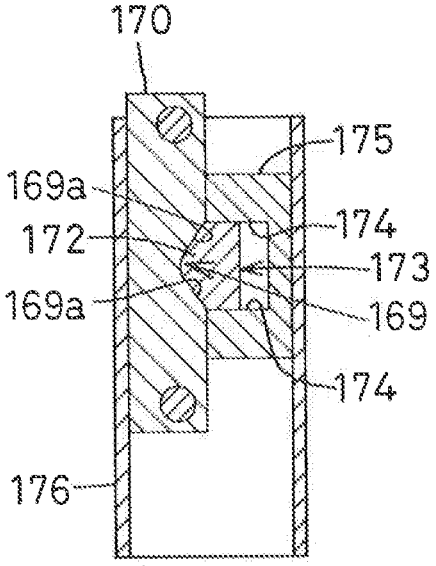
FIG. 50 is a horizontal sectional plan view taken along the line L-L in FIG. 48.

FIGS. 49 and 50 illustrate non-actuation of the operating means 110, the projection 172 of the locking member 173 engages in the recess 169 of the actuating member 170, and the engagement projections 171 of the locking member 173 engage with the engagement grooves 167 of the stopper member 168. Hence, the moving mechanism 152 which comprises the horizontally-moving member 153 fixed to the moving member 175 and right and left link arms 155 stop at a predetermined position. In FIG. 43, the fulcrum member 151 supported by the link arms 155 stops at a predetermined position, so that a biasing force of the second biasing means 40 is suitably adjusted via the biasing-force transmitting member 41.

Figure 51:
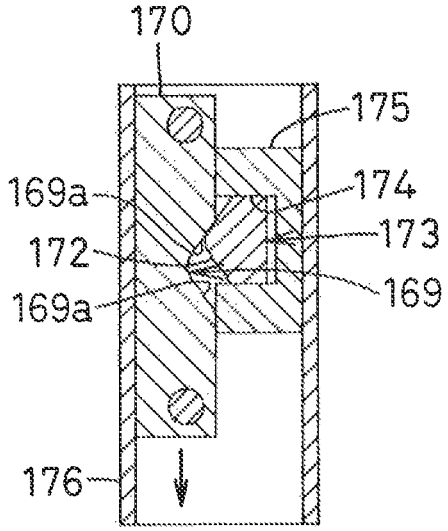
FIG. 51 is a horizontal sectional view similar to FIG. 50 when an actuating member moves forward.
Figure 52:
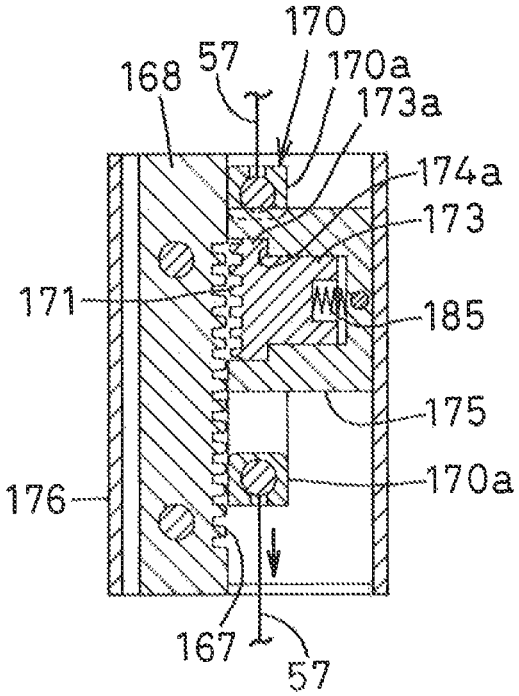
FIG. 52 is a horizontal sectional plan view similar to FIG. 49 when the actuating member moves forward.

In this state, by operating the operating means 110, the actuating member 170 is moved forward (downward in FIG. 49). In FIGS. 51, 52, the projection 172 of the locking member 173 gradually leaves the recess 169 and moves rightward by action of the projection 172 with the tilted surface 169*a* in the recess 169 of the actuating member 170. Thus, the engagement projections 171 of the locking member 173 gradually leave the engagement grooves 167 of the stopper member 168 and moves rightward until the right side of the wider portion 173*a* of the locking member 173 comes in contact with the wider recess 174*a* of the recess 174. The engagement projections 171 completely leave the engagement grooves 167 of the stopper member 168.

The locking member 173 moves rightward against a biasing force of the compression spring 185, and a resistant force is slightly applied to the operating means 110 via the actuating member 170 and inner wire 57. But the biasing force of the compression spring 185 is small and the operating means can be operated by a weak force.

The wider portion 173*a* of the locking member 173 comes in contact with the wider recess 174*a* of the recess 174, so that the locking member 173 is hindered from moving rightward. The projection 172 is prevented from leaving the recess 169 completely and the projection 172 is in sliding contact with the rear tilted surface 169*a* anytime. Hence, the operating means 110 is further operated to move the actuating member 170 forward, and the projection 172 is moved forward by the rear tilted surface 169*a* of the recess 169, thereby moving the moving mechanism 152 including the locking member 173, moving member 175 and horizontally-moving member 153. The right and left link arms 155 are inclined and laid. The fulcrum member 151 rolls along the biasing-force transmitting member 41 in FIG. 44 and moves downward smoothly, thereby adjusting the biasing force of the second biasing means 40 to be smaller. If the biasing force of the biasing means 40 should get larger, the operating means 110 is operated contrary to the above, and the actuating member 170 may be moved backward.

The fulcrum member 151 is in sliding contact with the biasing-force transmitting member 41 connected to the second biasing means 40, and the locking member 173 only moves with the moving member 175 and horizontally-moving member 153 while the compression spring 185 is compressed. A strong resistant force is not applied to the operating means 11 by the second biasing means 40 and compression spring 185 via the actuating member 170 and inner wire 57 connected to it. Hence, a biasing force transmitted to the backrest support rod 9 from the second biasing means 40 via the biasing-force transmitting means 41 can be adjusted by operating the operating means 110 by the same operating force anytime.

By using the biasing-force adjusting means 39 and position changing device 166 in this variation, the fulcrum member 151 is supported by the upper end of the link arm 155, and the lower end of the link arm 155 is moved longitudinally of the chair by the position changing device 166, thereby increasing a vertical moving range of the fulcrum member 151 and increasing an adjustable range of the biasing force of the second biasing means 40.

By simple operation that the actuating member 170 moves longitudinally of the chair with the operating means 110, a longitudinal position of the moving member 175 connected to locking member 173, horizontally-moving member 153 and the lower end of the link arm 155 can easily be changed. When the actuating member 170 is stopped, the engagement projections 171 of the locking member 173 engage in the engagement grooves 167 of the stopper member 168 by a biasing force of the compression spring 185, so that the moving member 175 and horizontally-moving member 153 can be stopped at a predetermined position.

Furthermore, the engagement projections 171 of the locking member 173 selectively engage in the engagement grooves 167 of the stopper member 168 thereby increasing a moving stroke of the moving member 175, horizontally-moving member 153 and link arm 155.

The engagement projections 171 of the locking member 173 engage with the engagement grooves 167 of the stopper member 168 within approximately the same plane, and under it, the projection 172 is in sliding contact with the recess 169 of the actuating member 170 within approximately the same plane. The locking member 173 is housed in the recess 174 of the moving member 175 thereby reducing a vertical size of the stopper member 168, locking member 173 and moving member 175 and a vertical size of the whole position changing device 166. Thus the height of the base 6 in which the position changing device 166 is installed can be reduced.

The present invention is not limited to the foregoing embodiments. Without departing from the scope of claims, for example, the following variation may be possible.

Instead of the compression spring 48 in the second biasing means 40, a gas spring may be used.

The gas spring may have a locking function and the locking device 32 may be omitted.

The fulcrum member 151 in the variation may be a plate without a roller. A contact surface with the biasing-force transmitting member 41 may be arcuate and the rear surface thereof may be in sliding contact with the vertical wall 11*e* of the base body 11. The support member 156 may thus be omitted.

Without the base plate 176 in the variation, the stopper member 168, actuating member 170 and locking member 173 may directly be assembled within the recess 158*d* on the upper surface of the rear lower cover 158.

Without the support plate 159, a sliding surface with which the horizontally-moving member 153 is in sliding contact may be formed on the upper surface of the rear lower cover 158*a*.

What is claimed is:

1. A chair comprising:

a base supported by a leg unit;

a seat over the base;

a pivot shaft pivotally mounted to the base transversely of the chair;

a backrest fixed at a front end to the pivot shaft and standing at a rear end of the seat, the backrest turning between an upright position where the backrest is upright and a rearward-inclined position where the backrest is inclined rearward around an axis of the pivot shaft;

a rotary member fixed at a proximal end to the pivot shaft;

a biasing-force transmitting member pivotally mounted at a proximal end to an eccentric portion of the rotary member via a shaft;

biasing means disposed between the biasing-force transmitting member and part of the base and storing a reaction force by compression;

a fulcrum member in the base, the fulcrum member being capable of coming in contact with a middle of a pressed side of the biasing-force transmitting member and of moving along the pressed side; and a moving member moving the fulcrum member along the pressed side of the biasing-force transmitting member, wherein the biasing-force transmitting member acts as a lever having a contact portion with the fulcrum member as fulcrum to reverse a biasing force of the biasing means acting on a distal end as a point of effort whereby the proximal end as a point of action biases the rotary member in a direction where the backrest stands up.

2. The chair of claim 1 wherein when the backrest is upright, the fulcrum member is spaced from the pressed side of the biasing-force transmitting member or is in contact with the pressed side so that a biasing force of the biasing means does not act on the fulcrum member.

3. The chair of claim 2 wherein between the pressed side of the biasing-force transmitting member and a wall of the base facing the fulcrum member, the fulcrum member slides along the wall.

4. The chair of claim 2 wherein the moving member comprises a pair of vertical link arms supported by the base to move longitudinally of the chair, the fulcrum member being disposed between facing surfaces of the pair of link arms.

5. The chair of claim 4 wherein lower parts of the pair of link arms are pivotally mounted to sides of a horizontally-moving member which is supported by the base to move longitudinally of the chair.

6. The chair of claim 1 wherein the contact portion of the fulcrum member to the biasing-force transmitting member is arcuate viewed from the axis of the pivot shaft.

7. The chair of claim 6 wherein the moving member comprises a pair of vertical link arms supported by the base to move longitudinally of the chair, the fulcrum member being disposed between facing surfaces of the pair of link arms.

8. The chair of claim 7 wherein lower parts of the pair of link arms are pivotally mounted to sides of a horizontally-moving member which is supported by the base to move longitudinally of the chair.

9. The chair of claim 1 wherein between the pressed side of the biasing-force transmitting member and a wall of the base facing the fulcrum member, the fulcrum member slides along the wall.

10. The chair of claim 9 wherein the moving member comprises a pair of vertical link arms supported by the base to move longitudinally of the chair, the fulcrum member being disposed between facing surfaces of the pair of link arms.

11. The chair of claim 1 wherein the moving member comprises a pair of vertical link arms supported by the base to move longitudinally of the chair, the fulcrum member being disposed between facing surfaces of the pair of link arms.

12. The chair of claim 11 wherein lower parts of the pair of link arms are pivotally mounted to sides of a horizontally-moving member which is supported by the base to move longitudinally of the chair.

13. The chair of claim 12 wherein the horizontally-moving member and a lower end of the link arm pivotally mounted to the horizontally-moving member are disposed behind and below the biasing means.

14. The chair of claim 12 wherein a pair of guide shafts projects on the horizontally-moving member and a pair of guide members is provided to move the pair of guide shafts.

15. The chair of claim 12 wherein the base has a sliding surface supporting the horizontally-moving member so that the horizontally-moving member slides longitudinally of the chair.

16. The chair of claim 11 wherein the fulcrum members in the pair of link arms comprise rollers rotating around a pivot shaft.

17. The chair of claim 11 wherein in the base there is provided a position-changing device for changing a longitudinal position of a horizontally-moving member and a lower part of the link arm and for stopping the horizontally-moving member and the lower part of the link arm.

18. The chair of claim 1 wherein when the backrest is upright, the fulcrum member is spaced from the pressed side of the biasing-force transmitting member or is in contact with the pressed side so that a biasing force of the biasing means does not act on the fulcrum member, and the contact portion of the fulcrum member to the biasing-force transmitting member is arcuate viewed from the axis of the pivot shaft.

19. The chair of claim 18 wherein between the pressed side of the biasing-force transmitting member and a wall of the base facing the fulcrum member, the fulcrum member slides along the wall.

20. The chair of claim 18 wherein the moving member comprises a pair of vertical link arms supported by the base to move longitudinally of the chair, the fulcrum member being disposed between facing surfaces of the pair of link arms.

* * * * *